US010448151B1

(12) United States Patent
McNair

(10) Patent No.: US 10,448,151 B1
(45) Date of Patent: Oct. 15, 2019

(54) MULTI-MICROPHONE SYSTEM AND METHOD

(71) Applicant: Vocollect, Inc., Pittsburgh, PA (US)

(72) Inventor: Arthur McNair, Pittsburgh, PA (US)

(73) Assignee: VOCOLLECT, INC., Pittsburgh, PA (US)

( * ) Notice: Subject to any disclaimer, the term of this patent is extended or adjusted under 35 U.S.C. 154(b) by 0 days.

(21) Appl. No.: 15/970,931

(22) Filed: May 4, 2018

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01)

(58) Field of Classification Search
CPC ..... H04R 3/005; H04R 1/406; H04R 1/326; H04R 2201/401; H04R 2430/21; H04R 2201/405; H04R 2430/20; H04R 29/005; H04R 3/02; H04R 19/016; H04R 29/00; H04R 29/004; H04R 2499/11; H04R 1/04; H04R 19/04
USPC ..... 381/56–58, 92, 95, 355, 368–369
See application file for complete search history.

(56) References Cited

U.S. PATENT DOCUMENTS

| | | | | |
|---|---|---|---|---|
| 7,106,876 | B2 | 9/2006 | Santiago | |
| 8,054,991 | B2 | 11/2011 | Tokuda et al. | |
| 8,111,838 | B2 | 2/2012 | Tokuda et al. | |
| 9,319,787 | B1 * | 4/2016 | Chu | H04R 3/005 |
| 2008/0049953 | A1 * | 2/2008 | Harney | H04R 1/245 381/94.7 |
| 2015/0117671 | A1 | 4/2015 | Chen et al. | |

* cited by examiner

*Primary Examiner* — Rasha S Al Aubaidi
(74) *Attorney, Agent, or Firm* — Alston & Bird LLP

(57) ABSTRACT

Provided herein are a multi-microphone system and method including a controller, a plurality of transducers each operable within a unique sensitivity range, and corresponding microphone units. The controller receives a sound signal output from a first microphone unit that corresponds to a microphone unit having a transducer with the highest sensitivity. The controller analyzes the sound signal output to identify a first parameter of the sound signal output and determines if the first parameter satisfies pre-defined criteria. In an instance in which the first parameter satisfies the pre-defined criteria, the controller outputs the sound signal output of the selected first microphone unit as the output of the multi-microphone system. Otherwise, the controller receives a sound signal output from a second microphone unit comprising a corresponding transducer with a sensitivity less than the first microphone unit but greater than remaining transducers.

20 Claims, 10 Drawing Sheets

MULTI-MICROPHONE SYSTEM AND METHOD

TECHNOLOGICAL FIELD

Example embodiments of the present disclosure relate generally to microphone systems, and, more particularly, to multi-microphone systems, transducers, and associated methods.

BACKGROUND

Conventional voice products, such as headsets, telephone sets, voice accessories, video conferencing equipment and the like, often receive input sound signals from various sound sources and generate a corresponding sound signal output. Typically, microphone systems in such voice products may operate in a limited sound range largely dependent upon a sensitivity range of the transducer used by the microphone system. On the lower end of this sensitivity range, the transducer may be limited by a minimum noise level of the transducer; and, on the higher end of the same sensitivity range, the transducer may be limited by a maximum sensitivity value at which the transducer is overloaded by the amplitude of the input sound signal. In order to maintain the input sound signal within the sensitivity range of the physical transducer, various gain mechanisms may be utilized by a microphone unit.

Applicant has identified a number of deficiencies and problems associated with conventional microphone systems. Through applied effort, ingenuity, and innovation, many of these identified problems have been solved by developing solutions that are included in embodiments of the present disclosure, many examples of which are described in detail herein.

BRIEF SUMMARY

A multi-microphone system utilizing multiple microphones to achieve a wide-sensitivity system is disclosed herein. The multi-microphone system may include a plurality of transducers. Each transducer of the plurality of transducers may be operable within a sensitivity range such that each transducer has a different sensitivity range than any other transducer of the plurality of transducers. In some embodiments, a sensitivity range of one transducer in one microphone unit may overlap a sensitivity range of next less sensitive transducer in another microphone unit. The multi-microphone system may further include a plurality of microphone units. Each microphone unit may include at least one transducer of the plurality of transducers. Each microphone unit may be configured to generate a sound signal output for a sound signal input. The multi-microphone system may further include a controller, communicatively coupled with each microphone unit. The controller may be configured to receive a sound signal output from a first microphone unit amongst the plurality of microphone units. The first microphone unit may correspond to a microphone unit including a transducer with the highest sensitivity of the plurality of transducers. The controller may be further configured to analyze the received sound signal output of the first microphone unit to identify a first parameter of the received sound signal output. Accordingly, it may be determined if the first parameter satisfies one or more pre-defined criteria.

In one or more embodiments, the first parameter may correspond to at least one of a signal clipping parameter of the first microphone unit, a difference value between a signal amplitude received by a first transducer of the first microphone unit and a midpoint of the sensitivity range of the first transducer of the first microphone unit, or a decibels full scale (dBFS) level of the sound signal output of the first microphone unit. The signal clipping parameter of the first microphone unit may indicate a distortion level of the sound signal output such that a zero value of the signal clipping parameter of the first microphone unit corresponds to an instance in which the sound signal output of the first microphone unit is not clipped.

In one or more embodiments, the first parameter may satisfy the one or more pre-defined criteria in an instance in which the sound signal output of the first microphone unit is not clipped, or the sound signal output being outside of sensitivity ranges of transducers of remaining microphone units of the plurality of microphone units with lower sensitivity ranges.

In an instance in which the first parameter satisfies the one or more pre-defined criteria, the controller may select the first microphone unit from amongst the plurality of microphone units and output the sound signal output of the selected first microphone unit as the output of the multi-microphone system. The controller may be further configured to set the selected first microphone unit as an active microphone unit of the multi-microphone system.

In alternate embodiments, the controller, in an instance in which the first parameter fails to satisfy the one or more pre-defined criteria, may be configured to analyze the received sound signal output of a second microphone unit to identify a second parameter of the received sound signal output. The second microphone unit may correspond to a microphone unit including a corresponding transducer with a sensitivity less than the first microphone unit but greater than remaining transducers of the plurality of transducers. It may be determined if the second parameter satisfies the one or more pre-defined criteria. In an instance in which the second parameter satisfies the one or more pre-defined criteria, the controller may select the second microphone unit from amongst the plurality of microphone units. The controller may be further configured to set the selected second microphone unit as the active microphone unit of the multi-microphone system. In an instance in which the second parameter fails to satisfy the one or more pre-defined criteria, the controller may iteratively receive sound signal outputs from subsequent microphone units each including respective transducers of decreasing sensitivity.

The controller may be further configured to indicate a gain level of the active microphone unit on an interface of the multi-microphone system and a sensitivity range of the active microphone unit on an interface of the multi-microphone system.

In alternate or additional embodiments, the controller may be configured to generate an N-bit or multi-byte representation of sound signal outputs of the plurality of microphone units. The generated N-bit or multi-byte representation may include one or more first sets of bits and one or more second sets of bits. The one or more first sets of bits in the N-bit or multi-byte representation may correspond to sound signal outputs of a first set of microphone units with sensitivity ranges equal to or greater than the sensitivity range of the selected first microphone unit. The one or more second sets of bits in the N-bit or multi-byte representation may correspond to sound signal outputs of a second set of microphone units with sensitivity ranges less than the sensitivity range of the selected first microphone unit. In an embodiment, the one or more second sets of bits in the N-bit or multi-byte representation may be zero.

In one embodiment, a method for a multi-microphone system may include generating a plurality of sound signal outputs by a plurality of corresponding microphone units. The method may further include receiving a sound signal output from a first microphone unit amongst the plurality of microphone units by a controller. The first microphone unit may correspond to a microphone unit including a transducer with the highest sensitivity of the plurality of transducers. The method may further include analyzing the received sound signal output of the first microphone unit by the controller to identify a first parameter of the received sound signal output. Accordingly, it may be determined if the first parameter satisfies one or more pre-defined criteria. In an instance in which the first parameter satisfies the one or more pre-defined criteria, the method may include selecting the first microphone unit from amongst the plurality of microphone units and outputting the sound signal output of the selected first microphone unit as the output of the multi-microphone system. The method may further include setting, by the controller, the selected first microphone unit as an active microphone unit of the multi-microphone system. In an instance in which the first parameter fails to satisfy the one or more pre-defined criteria, the method may include receiving a sound signal output from a second microphone unit by the controller. The second microphone unit may correspond to a microphone unit including a corresponding transducer with a sensitivity less than the first microphone unit but greater than remaining transducers of the plurality of transducers.

The above summary is provided merely for purposes of summarizing some embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments may be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure according to one or more embodiments of the present disclosure are shown and described with respect to the figures presented herein, in which.

DETAILED DESCRIPTION

Figure 1:
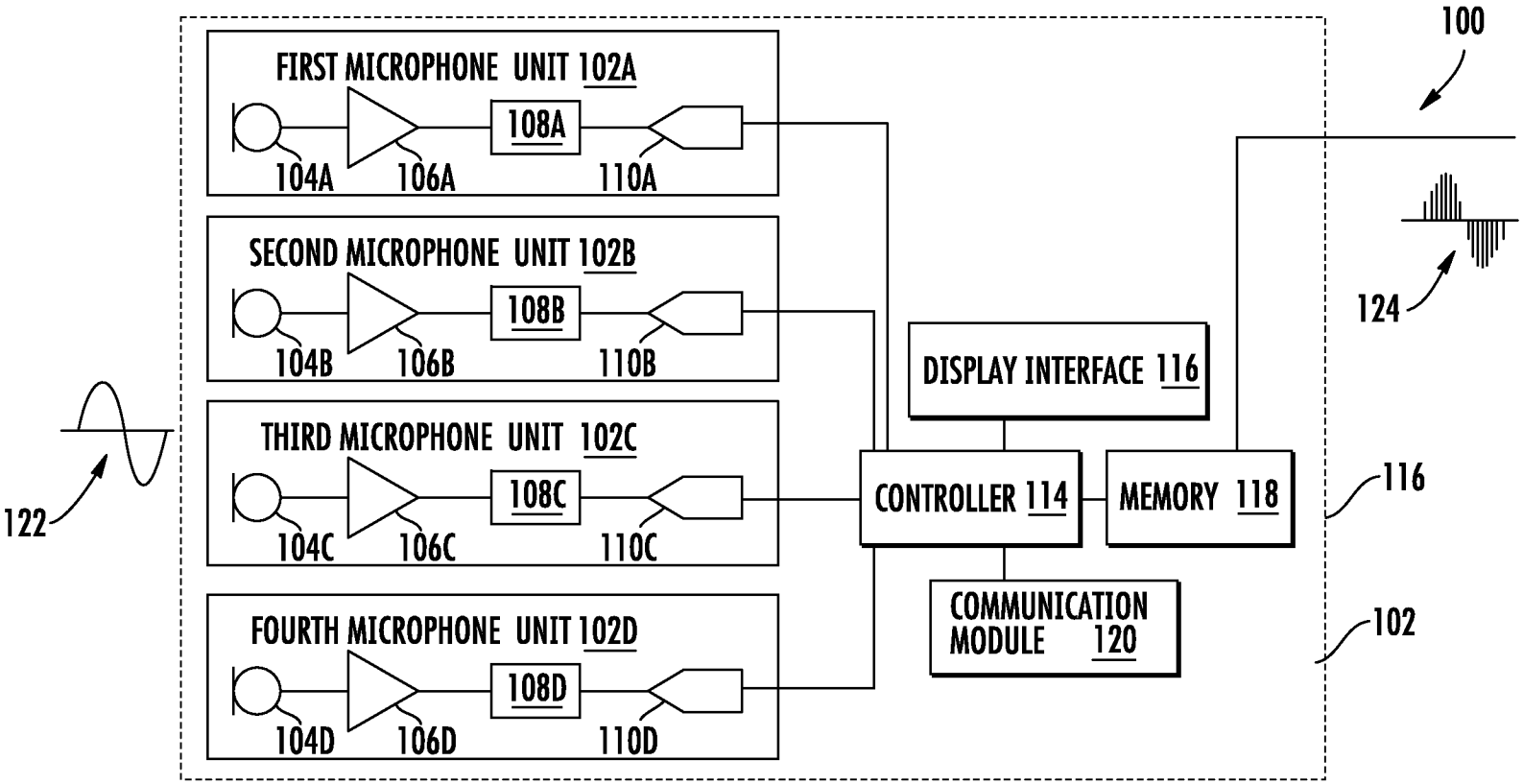
FIG. 1 illustrates a schematic diagram of a multi-microphone system, according to one or more embodiments of the present disclosure described herein.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

The term "comprising" means including but not limited to, and should be interpreted in the manner it is typically used in the patent context. Use of broader terms such as comprises, includes, and having should be understood to provide support for narrower terms such as consisting of, consisting essentially of, and comprised substantially of.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "may," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in an embodiment, or it may be excluded.

For the purposes of this description, a general reference to "memory" refers to memory accessible by the processors including internal memory or removable memory plugged into the device and memory within the processors themselves. For instance, memory may be any non-transitory computer readable medium having computer readable instructions (e.g., computer program instructions) stored thereof that are executable by a processor.

Conventionally, microphone systems in voice products include a single microphone unit that operates in a limited sound range dependent upon the sensitivity range of the transducer used in the microphone unit. On the lower end of this sensitivity range, the transducer may be limited by a minimum noise level of the transducer; on the higher end of the same sensitivity range, the transducer may be limited by a maximum sensitivity value at which the transducer is overloaded by the amplitude of the input sound signal. In order to maintain the input sound signal within the sensitivity range of the physical transducer, various gain mechanisms may be utilized by a microphone unit. However, in such cases, when one or more parameters associated with the input sound signal is less than the lower threshold value or higher than the upper threshold value for the given physical transducer sensitivity range, such gain mechanisms may become ineffective and inaccurate. This may result in an associated performance failure of the microphone unit. In this way, conventional microphone systems are limited to non-high-noise environments because the microphones may not accurately address with the input sound signal levels at the extreme low and extreme high ends of the sensitivity range of the transducer.

To address these technical problems, the embodiments of the present application provide a multi-microphone system with microphones operable in different sensitivity ranges in order to provide a wide range of operability for identifying sound inputs. A controller in the multi-microphone system, for example, may be coupled to the plurality of microphone units and may check a measure of each microphone unit output over a time duration to confirm that the microphone is not overdriven (e.g. no clipping, no maximum values, or level not into range of less-sensitive microphone units). The controller may traverse each microphone unit based on an order of decreasing sensitivity ranges of the plurality of transducers in the plurality of microphone units. If the controller determines that the microphone is not overdriven, the controller selects the microphone unit from the plurality of microphone units and sets the selected microphone unit to be an active microphone unit with the highest (i.e. the optimal) transducer sensitivity range for identifying the sound input. For the optimal microphone unit, the sound signal output falls within the sensitivity range associated with a transducer of the microphone unit without any signal clipping/distortion. If the microphone unit is determined to be overdriven over the time duration, the sound signal outputs of the remaining microphone units are iteratively analyzed in order of decreasing sensitivity ranges of transducers until a sound signal output of a microphone unit is determined to be not overdriven. In this way, at least one microphone unit of the multi-microphone system is able to accurately measure the input sound signal and generate an optimal sound signal output. Such a wide-sensitivity multi-microphone system may thus be operable in a variety of noise environments (e.g., environments with sound signals of varying levels), thereby alleviating the need for any hardware-level gain control, such as those found in conventional systems.

Having described example embodiments of the present disclosure generally, particular features and functionality of the various devices are hereinafter described.

The components illustrated in the figures represent components that may or may not be present in various embodiments of the disclosure described herein such that embodiments may include fewer or more components than those shown in the figures while not departing from the scope of the disclosure.

FIG. 1 illustrates a schematic block diagram of a multi-microphone system 100, according to one or more embodiments of the present disclosure. As illustrated in FIG. 1, in an example embodiment, the circuitry of the multi-microphone system 100 may include a plurality of microphone units 102, such as a first microphone unit 102A, a second microphone unit 102B, a third microphone unit 102C, and a fourth microphone unit 102D. Although described herein with reference to FIG. 1 illustrating four microphone units, the present disclosure contemplates that the plurality of microphone units 102 may include any number of microphone units, without deviation from the scope of the disclosure. Each of the plurality of microphone units 102 may further include various electronic components, such as, but not limited to, a transducer, an amplifier, an active noise control (ANC) module, an analog-to-digital converter (ADC), and an indicator.

With continued reference to FIG. 1, in an example embodiment, the first microphone unit 102A may include a first transducer 104A, a first amplifier 106A, a first ANC module 108A, and a first ADC 110A. The second microphone unit 102B may include a second transducer 104B, a second amplifier 106B, a second ANC module 108B, and a second ADC 110B. The third microphone unit 102C may include a third transducer 104C, a third amplifier 106C, a third ANC module 108C, and a third ADC 110C. The fourth microphone unit 102D may include a fourth transducer 104D, a fourth amplifier 106D, a fourth ANC module 108D, and a fourth ADC 110D. Although described herein with reference to FIG. 1 illustrating four electronic components, the present disclosure contemplates that additional electronic components, other than the above four electronic components described above, may be implemented in each microphone unit in the circuitry of the multi-microphone system 100, without deviation from the scope of the disclosure.

As illustrated in FIG. 1, in accordance with an embodiment, the circuitry of the multi-microphone system 100 may further include a controller 114, a display interface 116, a memory 118, and a communication module 120. FIG. 1 further illustrates an input sound signal 122 received by the plurality of microphone units 102 and an output digital signal 124 generated by a selected microphone unit of the plurality of microphone units 102. The controller 114 may include one or more processors communicatively coupled with each of the plurality of microphone units 102, the display interface 116, the memory 118, and the communication module 120.

In this regard, each of the plurality of microphone units 102, the controller 114, the memory 118, and the communication module 120 may have one or more respective chipsets or hardware units. Such chipsets may operate based on a chipset specification, including parameters or operating conditions, throughout the description. In this regard, as described previously, the chipset specification may be accessible via interpretation or processing, of software code containing hardware specific drivers, and other routines which drives operation for such chipsets. Additionally, the chipset specification may be indicative of, but not limited to, modes of operation, threshold values, or any other parameter that influence operations, functions, or performance associated with any of such chipsets.

As referred to herein, "module" or "unit" includes hardware, software and/or firmware configured to perform one or more specific functions. In this regard, the means of the circuitry of the multi-microphone system 100, as described herein, may be embodied as, for example, circuitry, hardware elements (such as, a suitably programmed processor, combinational logic circuit, and/or the like), a computer program product comprising computer-readable program instructions stored on a non-transitory computer-readable medium (such as, the memory 118) that is executable by a suitably configured processing device (such as, the controller 114), or some combination thereof.

Each of the plurality of microphone units 102 may include suitable logic, circuitry, interfaces, and/or code that may be configured to receive sound signals, such as the input sound signal 122, from a sound source and generate a corresponding digital sound signal. Each of the plurality of microphone units 102 may include at least a transducer, an amplifier, an ANC module, and an ADC to generate the digital sound signal. Examples of various types of the microphone units may include, but are not limited to, a dynamic microphone, which uses a coil of wire suspended in a magnetic field, a condenser microphone, which uses the vibrating diaphragm as a capacitor plate, and a piezoelectric microphone, which uses a crystal of piezoelectric material.

In some embodiments, the plurality of microphone units 102 may be connected to a preamplifier (not shown) before the sound signal can be recorded or reproduced. The microphone units of the present disclosure may be used in various applications, such as telephones, hearing aids, public address systems for concert halls and public events, motion picture production, live and recorded audio engineering, sound recording, two-way radios, megaphones, radio and television broadcasting, and in computers for recording voice, speech recognition, VoW, and for non-acoustic purposes, such as ultrasonic sensors or knock sensors.

Each transducer (e.g., the first transducer 104A, the second transducer 104B, the third transducer 104C, and the fourth transducer 104D) may include a suitable sensor, circuitry, and/or interface that may be configured to receive a sound signal, such as the input sound signal 122, from a sound source. Each transducer may further be operable within a sensitivity range such that each transducer has a different sensitivity range than other transducers of the plurality of transducers. Each transducer, in accordance with the corresponding sensitivity range, may be configured to convert air pressure variations of a sound wave of the input sound signal 122 to a low-power electrical signal, in accordance with any known technique, based on the type of the microphone (e.g., such as those described above). In an embodiment, a sensitivity range of one transducer in one microphone unit may overlap a sensitivity range of next less sensitive transducer in another microphone.

Each amplifier (e.g., the first amplifier 106A, the second amplifier 106B, the third amplifier 106C, and the fourth amplifier 106D) may include suitable logic, circuitry, interfaces, and/or code that may be configured to amplify the low-power electrical signals, generated by a coupled transducer, to a defined power level. Each amplifier may be associated with one or more design parameters or characteristics, such as the amplitude, the frequency response, or the gain, based on which the low-power electrical signals are amplified.

Each ANC module (e.g., the first ANC module 108A, the second ANC module 108B, the third ANC module 108C, and the fourth ANC module 108D) may include suitable logic, circuitry, interfaces, and/or code that may be configured to analyze the waveform of a background aural or non-aural noise in the amplified electrical signal (generated by the coupled amplifier) that corresponds to the input sound signal 122. Based on various algorithms for noise cancellation, the ANC modules may generate a signal that may either phase-shift or invert the polarity of the amplified electrical signal that corresponds to the input sound signal 122. The inverted signal (in anti-phase) may be further amplified. A transducer (not shown) in the ANC module may create a sound signal directly proportional to the amplitude of the waveform of the amplified electrical signal in order to create a destructive interference to reduce the volume of the perceivable noise in the amplified electrical signal. It may be noted that for noise control, other noise control/cancelling circuits may be also used, without deviation from the scope of the disclosure.

Each ADC (e.g., the first ADC 110A, the second ADC 110B, the third ADC 110C, and the fourth ADC 110D) may include suitable logic, circuitry, interfaces, and/or code that may be configured to receive a noise-free amplified electrical signal from the corresponding ANC module and generate a corresponding digital signal. The digital signal may be a discrete-time signal for which both time and amplitude of the noise-free amplified electrical signal have discrete values. The digital signal may be represented by digital words of a finite width. To convert a noise-free, amplified electrical signal to the digital signal, each ADC may first generate a continuous-valued, discrete-time signal through sampling, then replace each sample value by an approximation selected from a given discrete set through quantization. In various embodiments, the generated digital signal may be represented as, for example, one of 8-bit (256 levels), 16-bit (65,536 levels), 24-bit (16.8 million levels), and 32-bit (4.3 billion levels).

The controller 114 may be embodied as one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an application specific integrated circuit (ASIC) or field programmable gate array (FPGA), or some combination thereof. Accordingly, although described herein with reference to a single controller in an example embodiment, the present disclosure contemplates that the controller 114 may include a plurality of processors and signal processing modules, without deviation from the scope of the disclosure. The plurality of processors may be embodied on a single electronic device or may be distributed across a plurality of electronic devices collectively configured to function as the circuitry of the multi-microphone system 100. The plurality of processors may be in operative communication with each other and may be collectively configured to perform one or more functionalities of the circuitry of the multi-microphone system 100, as described herein. In an example embodiment, the controller 114 may be configured to execute instructions stored in the memory 118 or otherwise accessible to the controller 114. These instructions, when executed by the controller 114, may cause the circuitry of the multi-microphone system 100 to perform one or more of the functionalities, as described herein.

Whether configured by hardware, firmware/software methods, or by a combination thereof, the controller 114 may include an entity capable of performing operations according to embodiments of the present disclosure while configured accordingly. Thus, for example, when the controller 114 is embodied as an ASIC, FPGA or the like, the controller 114 may include specifically configured hardware for conducting one or more operations described herein. Alternatively, in another example, when the controller 114 is embodied as an executor of instructions retrieved from the memory 118, the instructions may specifically configure the controller 114 to perform one or more algorithms and operations described herein.

Thus, the controller 114 used herein may refer to a programmable microprocessor, microcomputer, or multiple processor chip(s) that can be configured by software instructions (applications) to perform a variety of functions, including the functions of the various embodiments described above. In some devices, multiple processors may be provided dedicated to wireless communication functions and one processor dedicated to running other applications. Software applications may be stored in the internal memory before they are accessed and loaded into the processors. The processors may include internal memory sufficient to store the application software instructions. In many devices, the internal memory may be a volatile or nonvolatile memory, such as flash memory, or a mixture of both. The memory can also be located internal to another computing resource (e.g., enabling computer readable instructions to be downloaded over the Internet or another wired or wireless connection).

In some embodiments, the controller 114 may include suitable logic, circuitry, interfaces, and/or code that may be configured to receive a plurality of sound signal outputs from the plurality of microphone units 102. In an embodiment, as described in FIG. 4, the controller 114 may be configured to receive a sound signal output from the first microphone unit 102A amongst the plurality of microphone units 102 such that the first microphone unit 102A corresponds to a microphone unit comprising a transducer (e.g., first transducer 104A) with the highest sensitivity of the plurality of transducers 104. The controller 114 may be further configured to analyze the received sound signal output of the first microphone unit 102A to identify a first parameter of the received sound signal output. The first parameter may correspond to at least one of a signal clipping parameter of the first microphone unit 102A, a difference between a signal amplitude received by the first transducer 104A of the first microphone unit 102A and a midpoint of the sensitivity range of the first transducer 104A of the first microphone unit 102A, or the dBFS level of the sound signal output of the first microphone unit 102A. In an embodiment, the signal clipping parameter of the first microphone unit 102A may indicate a distortion level of the sound signal output such that a zero value of the signal clipping parameter of the first microphone unit 102A corresponds to an instance in which the sound signal output of the first microphone unit 102A is not clipped.

The controller 114 may be further configured to determine if the first parameter satisfies one or more pre-defined criteria. The first parameter may satisfy the one or more pre-defined criteria in an instance in which the sound signal output of the first microphone unit 102A is not clipped, or in an instance in which the sound signal output is outside of sensitivity ranges of transducers of remaining microphone units of the plurality of microphone units 102 (e.g., each of which has a decreasing sensitivity range). In an instance in which the first parameter satisfies the one or more pre-defined criteria, the controller 114 may be further configured to select the first microphone unit 102A from amongst the plurality of microphone units 102 and output the sound signal output of the selected first microphone unit 102A as the output of the multi-microphone system 100.

Figure 6:
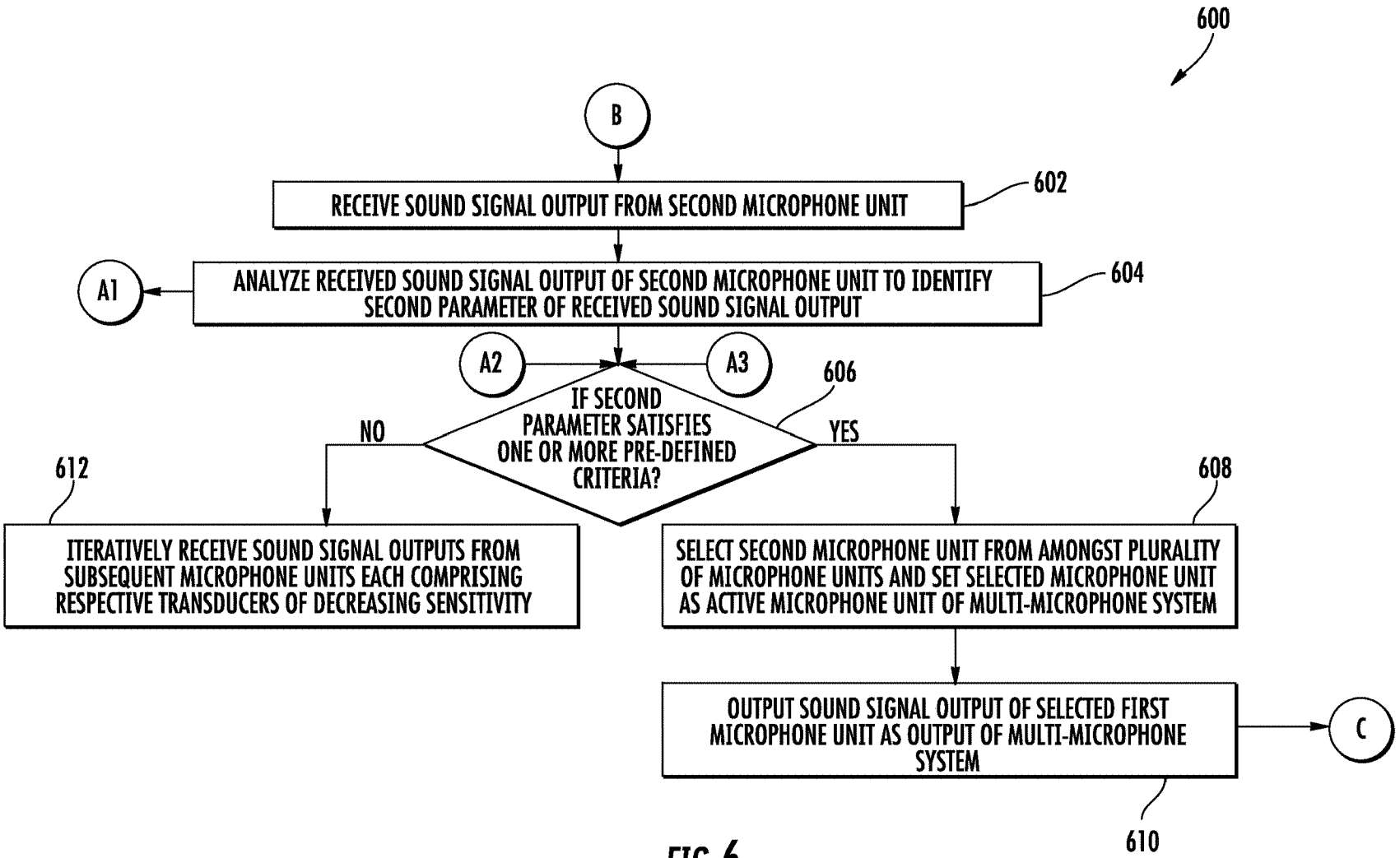
FIG. 6 illustrates a flowchart depicting a method for switching to a second microphone, according to one or more embodiments of the present disclosure described herein.

In another embodiment, as described in FIG. 6, the controller 114 may be configured to, in an instance in which the first parameter fails to satisfy the one or more pre-defined criteria, receive a sound signal output from the second microphone unit 102B. The second microphone unit 102B may correspond to a microphone unit comprising the corresponding second transducer 104B with a sensitivity range less than the sensitivity range of the first transducer 104A in the first microphone unit 102A, but greater than sensitivity ranges of any remaining transducers of the plurality of transducers 104. The controller 114 may be configured to analyze the received sound signal output of the second microphone unit 102B to identify a second parameter of the received sound signal output, and determine that the second parameter satisfies the one or more pre-defined criteria. In an instance in which the second parameter satisfies the one or more pre-defined criteria, the controller 114 may be configured to select the second microphone unit 102B from amongst the plurality of microphone units 102 and output the sound signal output of the selected second microphone unit 102B as the output of the multi-microphone system 100. In an instance in which the second parameter fails to satisfy the one or more pre-defined criteria, the controller 114 may be configured to iteratively receive sound signal outputs from subsequent microphone units, i.e. the third microphone unit 102C and the fourth microphone unit 102D, etc. each including respective transducers of decreasing sensitivity. During each iteration, the controller 114 may be configured to perform the same steps as described (in FIG. 4 for example) to identify a microphone unit that is not overdriven, and select this microphone unit such that the corresponding output of the sound signal of the selected microphone unit is the output of the multi-microphone system 100.

In an embodiment, the controller 114 may be further configured to indicate a gain level of the selected microphone unit on the display interface 116 of the multi-microphone system 100. The controller 114 may be further configured to indicate the sensitivity range of the selected microphone unit on the display interface 116 of the multi-microphone system 100.

Figure 4:
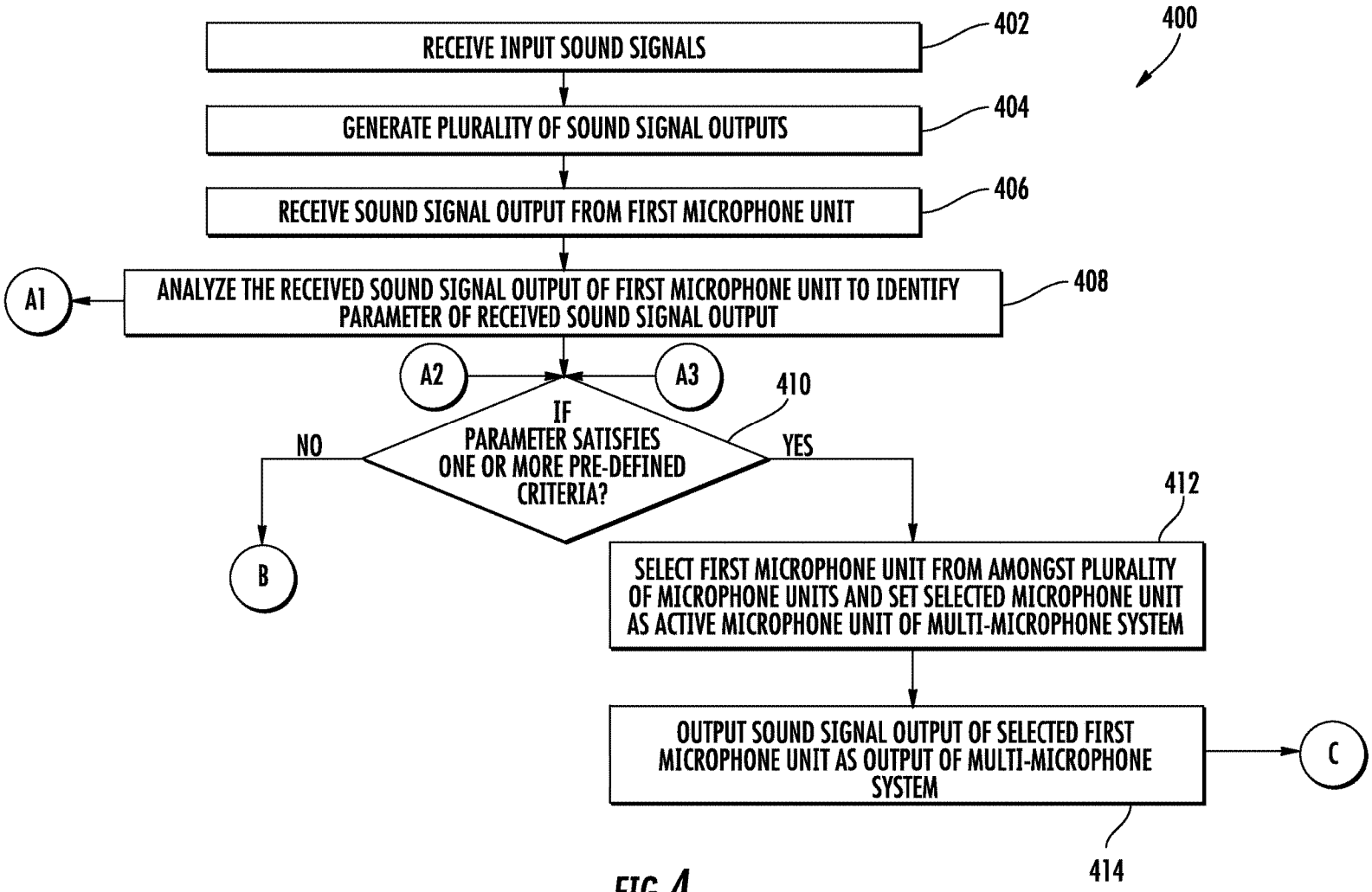
FIG. 4 illustrates a flowchart depicting a method for outputting a sound signal from a multi-microphone system, according to one or more embodiments of the present disclosure described herein.

The display interface 116 may include suitable logic, circuitry, interfaces, and/or code that may be configured to, under the control of the controller 114, provide an indication of a gain level of a selected microphone unit, such as the first microphone unit 102A or the second microphone unit 102B as described in accordance with flowcharts 400 and 600 of FIGS. 4 and 6, respectively. The display interface 116 may be further configured to indicate information about the sensitivity range provided by an active microphone unit for the input sound signal 122.

The indications, provided by the display interface 116, about the currently selected microphone unit may be useful to an external consumer of the multi-microphone system 100 as indicating the overall level of the input sound signal 122. For example, if the sound signal output corresponds to the first microphone unit 102A (e.g., having the highest sensitivity), then the knowledge that the first microphone unit 102A is active may indicate, for example in terms of relative units, that the input sound signal 122 is in the range of 1-10. If the sound signal output corresponds to the second microphone unit 102B (which is the less sensitive than the first microphone unit 102A), then the knowledge that the second microphone unit 102B is active may indicate, for example in terms of relative units, that the input sound signal 122 is in the range of 11-100. If the sound signal output corresponds to the third microphone unit 102C (e.g., less sensitive than the second microphone unit 102B), then the knowledge that the third microphone unit 102C is active may indicate, for example in terms of relative units, that the input sound signal 122 is in the range of 101-1000. If the sound signal output corresponds to the fourth microphone unit 102D (e.g., less sensitive than the third microphone unit 102C), then the knowledge that the fourth microphone unit 102D is active may indicate, for example in terms of relative units, that the input sound signal 122 is in the range of 1001-10000. Although described herein with reference to FIG. 1 illustrating exemplary ranges of the input sound signal 122 in accordance with an exemplary case, the present disclosure contemplates that in other cases the range may be different, other than the ones described above, in accordance with the type of sound source and the environmental conditions, without deviation from the scope of the disclosure.

The memory 118 may include, for example, volatile memory, non-volatile memory, or some combination thereof. Although illustrated in FIG. 1 as a single memory, the memory 118 may include a plurality of memory components. The plurality of memory components may be embodied on a single electronic device or distributed across a plurality of electronic devices. In various embodiments, the memory 118 may include, for example, a hard disk, random access memory, cache memory, read only memory (ROM), erasable programmable read-only memory (EPROM) & electrically erasable programmable read-only memory (EEPROM), flash memory, magnetic cassettes, magnetic tape, magnetic disk storage or other magnetic storage devices, a compact disc read only memory (CD-ROM), digital versatile disc read only memory (DVD-ROM), an optical disc, circuitry configured to store information, or some combination thereof. The memory 118 may be configured to store instructions and/or applications for enabling the circuitry of the multi-microphone system 100 to carry out various functions in accordance with example embodiments of the present disclosure. For example, in at least some embodiments, the memory 118 may be configured to buffer the input sound signal 122 for processing by the controller 114. Additionally, or alternatively, in at least some embodiments, the memory 118 is configured to store program instructions and/or application programs related to various audio processing algorithms for execution by the controller 114. The memory 118 may store information in the form of static and/or dynamic information. This information may be stored and/or used by the circuitry of the multi-microphone system 100 to perform various functionalities as described herein.

The communication module 120 may be embodied as an interface, device, or means embodied in circuitry, hardware, a computer program product including computer readable program instructions stored on a computer readable medium (e.g., the memory 118) and executed by a processing device (e.g., the controller 114), or any combination thereof that is configured to receive/transmit data from/to another device and/or network. In an example embodiment, the communication module 120 (like other components discussed herein) may be at least partially embodied as or otherwise controlled by the controller 114. In this regard, the communication module 120 may be in communication with the controller 114, such as via a bus. The communication module 120 may include, for example, an antenna, a transmitter, a receiver, a transceiver, a network interface card, and/or supporting hardware and/or firmware/software to enable communication with another electronic device. The communication module 120 may be configured to receive and/or transmit signals and/or data that may be stored by the memory 118 by use of a protocol for communication between various electronic devices. The communication module 120 may additionally or alternatively be in communication with the memory 118 and/or any other component of the circuitry of the multi-microphone system 100, via a means, such as a bus.

Figure 2:
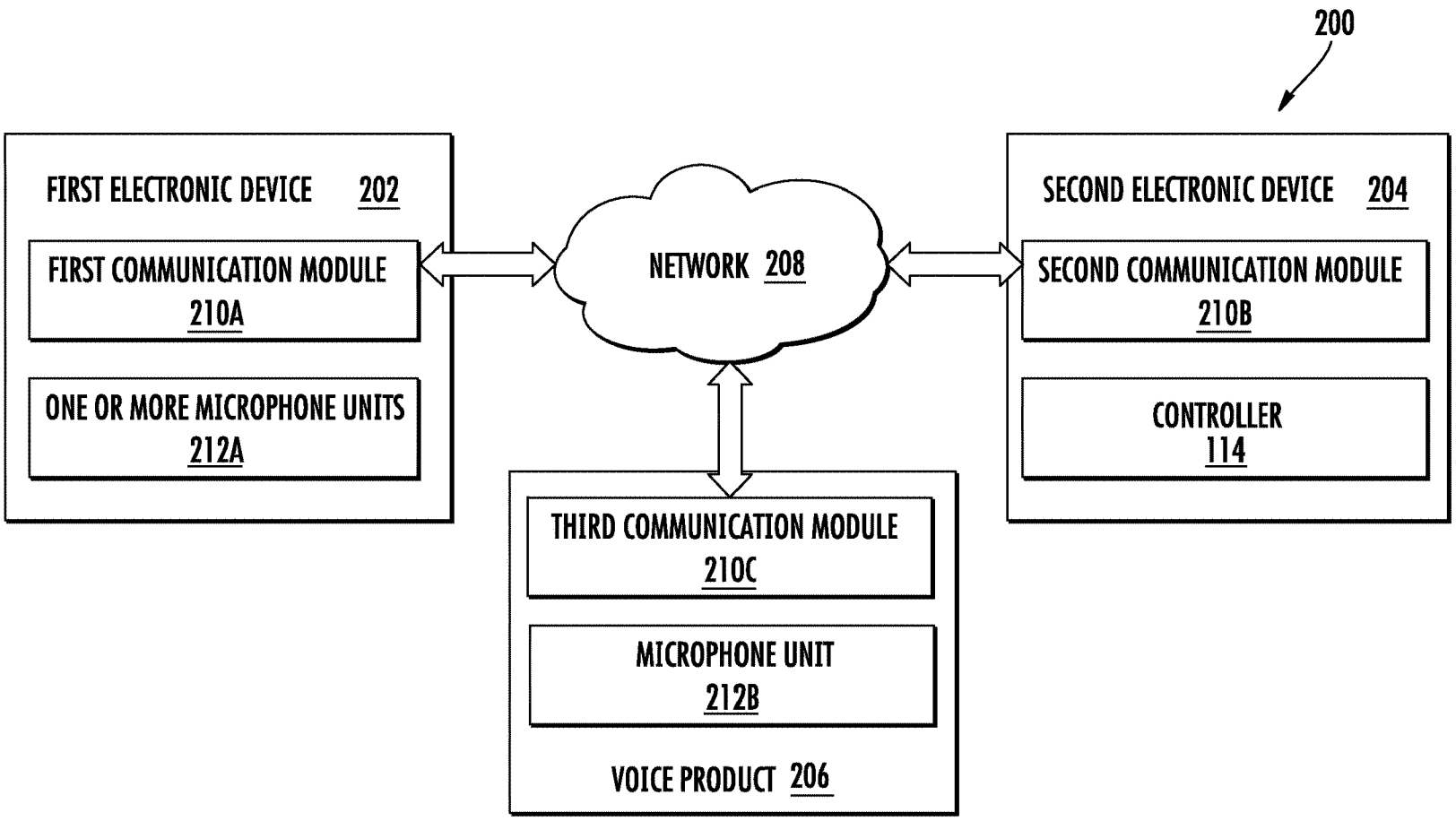
FIG. 2 illustrates a schematic diagram of a multi-microphone system in a network environment, according to one or more embodiments of the present disclosure described herein.
Figure 3A:
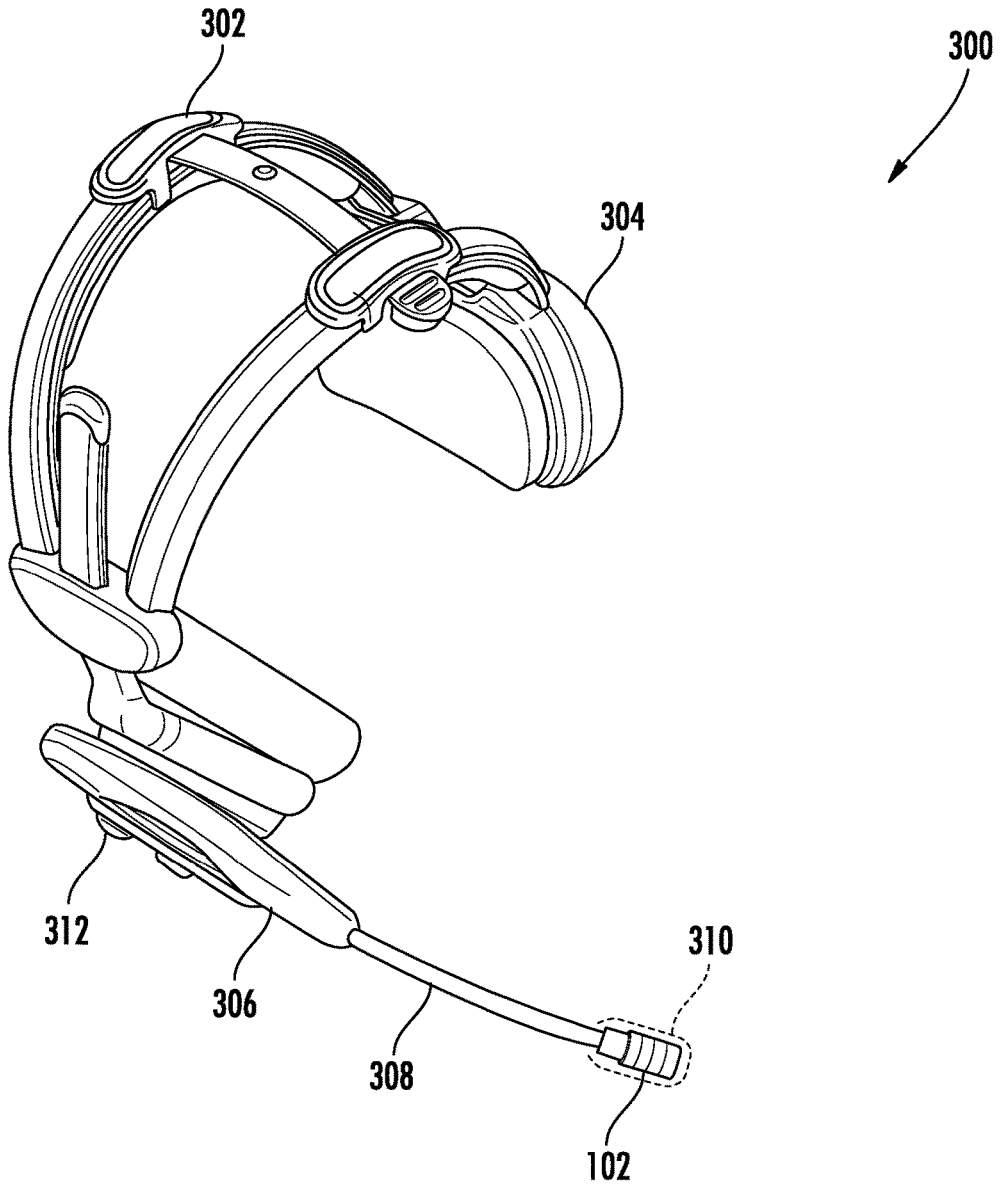
FIGS. 3A and 3B, collectively illustrate a schematic diagram of a voice product, according to one or more embodiments of the present disclosure described herein.
Figure 3B:
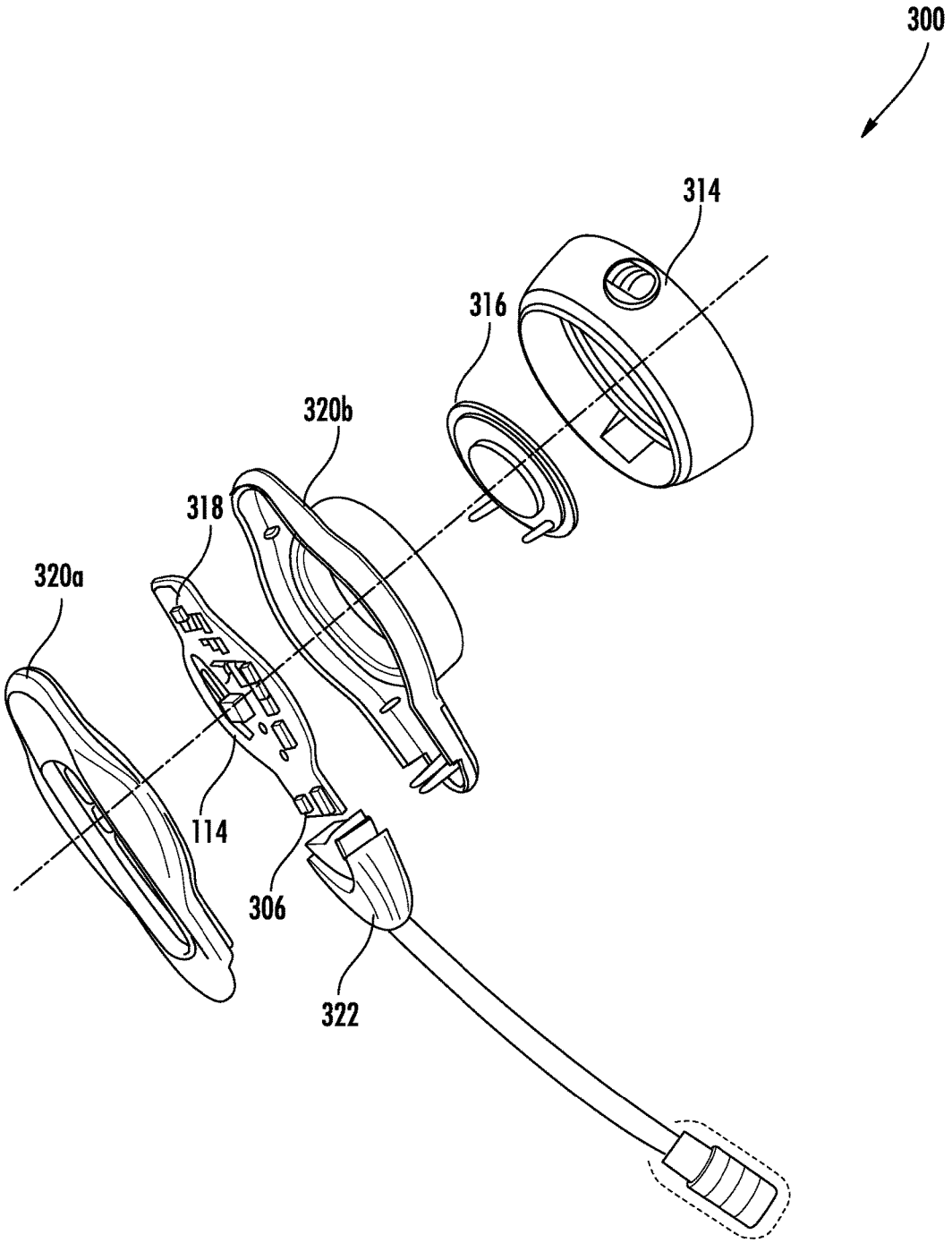

In accordance with various embodiments, some or all of the aforesaid components may be included in, for example, one or more user devices, as described in FIG. 2 and FIGS. 3A and 3B. Any of the afore-mentioned devices may include the circuitry of the multi-microphone system 100 and may be configured to, either independently or jointly with other devices in a network, perform the functions of the circuitry of the multi-microphone system 100, as described herein.

As will be appreciated, any computer program instructions and/or other type of code may be loaded onto a computer, processor or other programmable apparatus's circuitry to produce a machine, such that the computer, processor, or other programmable circuitry that execute the code on the machine create the means for implementing various functions, including those described herein.

It is also noted that all or some of the information presented by the examples discussed herein may be based on data that is received, generated and/or maintained by one or more components of a local or networked system and/or the circuitry of the multi-microphone system 100. In an example embodiment, one or more external systems (such as a remote cloud computing and/or data storage system) may also be leveraged to provide at least some of the functionality discussed herein.

As described above and as will be appreciated that, based on this disclosure, embodiments of the present disclosure may be configured as methods, personal computers, servers, mobile devices, backend network devices, and the like. Accordingly, embodiments may include various means comprised entirely of hardware or any combination of software and hardware. Furthermore, embodiments may take the form of a computer program product on at least one non-transitory computer-readable storage medium having computer-readable program instructions (such as, computer software) embodied in the storage medium. Any suitable computer-readable storage medium may be utilized including non-transitory hard disks, CD-ROMs, flash memory, optical storage devices, or magnetic storage devices.

These computer program instructions may also be stored in a computer-readable storage device (such as, the memory 118) that may direct a computer or other programmable data processing apparatus to function in a particular manner, such that the instructions stored in the computer-readable storage device produce an article of manufacture including computer-readable instructions for implementing the function discussed herein. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions discussed herein.

FIG. 2 illustrates a schematic diagram of the multi-microphone system 100 in a network environment 200, according to one or more embodiments of the present disclosure. The network environment 200 in FIG. 2 is described in conjunction with FIG. 1. With reference to FIG. 2, a first electronic device 202, a second electronic device 204, a voice product 206, and a network 208 are illustrated. The circuitry of the multi-microphone system 100 (e.g., shown in FIG. 1) is illustrated as implemented in the network environment 200 in a distributed manner. For example, one or more microphone units 212A (e.g., in the first electronic device 202) and a microphone unit 212B (e.g., in the voice product 206), collectively correspond to the plurality of microphone units 102, as described in FIG. 1. The network environment 200, as illustrated in FIG. 2, may be implemented in an embodiment, where the one or more microphone units 212A (e.g., in the first electronic device 202) and the microphone unit 212B (e.g., in the voice product 206) are in a specified proximity with respect to each other and a sound source.

Further, the controller 114, as described in FIG. 1, is illustrated as implemented in the second electronic device 204 in FIG. 2. Furthermore, a first communication module 210A, a second communication module 210B, and a third communication module 210C, which may be functionally similar to the communication module 120 (as described in FIG. 1), are illustrated implemented in the first electronic device 202, the second electronic device 204, and the voice product 206, respectively, in FIG. 2. The first electronic device 202, the second electronic device 204, and the voice product 206 may be communicatively coupled with each other via the first communication module 210A, the second communication module 210B, and the third communication module 210C, respectively, through the network 208.

The first electronic device 202 may include suitable logic, circuitry, interfaces, and/or code that may be configured to be discovered by other device, such as the second electronic device 204 and/or the voice product 206 in the network 208, without the need for physical device configuration or user intervention in resolving resource conflicts. The first electronic device 202 may further include the first communication module 210A that may facilitate a communicative coupling between the first electronic device 202 and other devices, such as the second electronic device 204 and the voice product 206, through the network 208. In an example embodiment, the first electronic device 202 may be a peripheral device that may be readily integrated with the voice product 206, via a direct, wired, or wireless interface of the first communication module 210A and the second communication module 210B respectively, through the network 208. In some embodiments, the transducers in the one or more microphone units 212A may be configured to convert the captured input sound signals into an analog or digital format of electrical signals. Examples of the first electronic device 202 may include, but not limited to, a plug and play device or a computer bus.

The second electronic device 204 may include suitable logic, circuitry, interfaces, and/or code that may be configured to perform key functionalities for selection of a microphone unit from the one or more microphone units 212A (in the first electronic device 202) and the microphone unit 212B (in the voice product 206) in the network environment 200. The second electronic device 204 may include the controller 114, the functionalities of which have been described in detail in FIG. 1. The second electronic device 204 may further include the second communication module 210B that may facilitate a communicative coupling between the second electronic device 204 and other devices, such as the first electronic device 202 and the voice product 206, through the network 208.

In an example embodiment, the second electronic device 204 may include a server module (e.g., running an application which may cause the computing device to operate as a server) capable of controlling multiple microphone units in the multi-microphone system 100 such that an optimal sound signal output is generated through a selected microphone unit. The server module (e.g., server application) may be one of a full function server module or a light or secondary server module (e.g., light or secondary server application) that is configured to provide synchronization services among the various electronic devices in the network environment 200. A light server or secondary server may be a smaller version of server type functionality that can be implemented on a computing device, such as a smart phone, thereby enabling it to function as an Internet server (e.g., an enterprise e-mail server) only to the extent necessary to provide the functionality described herein.

In another embodiment, the second electronic device 204 may correspond to an audio processing device capable of controlling multiple microphone units in the multi-microphone system 100 such that an optimal sound signal output is generated through a selected microphone unit. In accordance with various implementations, the second electronic device 204 may correspond to programmable logic controllers (PLCs), programmable automation controllers (PACs), industrial computers, desktop computers, personal data assistants (PDAs), laptop computers, tablet computers, smart books, palm-top computers, personal computers, smart devices, and similar electronic devices equipped with at least a processor configured to perform the various operations described herein.

The voice product 206 may correspond to a sound capturing device including at least one sound transducer (e.g., in the microphone unit 212B) and one or more modules (not shown) configured to process the input sound signals received from a sound source in the network environment 200. In an embodiment, the transducer in the microphone unit 212B may be configured to convert the captured input sound signals into an analog or digital format of electrical signals. The voice product 206 may further include the third communication module 210C that may facilitate a communicative coupling between the voice product 206 and other devices, such as the first electronic device 202 and the second electronic device 204. Examples of the voice product 206 may include a wearable single-mic headset apparatus, a voice-conference system that includes a single microphone, and the like.

The network 208 may include a medium through which various distributed devices, such as the first electronic device 202, the second electronic device 204, and the voice product 206, may communicate with each other. Examples of the network 208 may include, but are not limited to, a cloud network, short range networks (such as a home network), a two-way radio frequency network (such as a Bluetooth-based network), a Wireless Fidelity (Wi-Fi) network, a Wireless Personal Area Network (WPAN), Local Area Network (LAN), a Metropolitan Area Network (MAN), a dedicated short-range communication (DSRC) network, a mobile ad-hoc network (MANET), Internet based mobile ad-hoc networks (IMANET), a wireless sensor network (WSN), a wireless mesh network (WMN), a Wireless Local Area Network (WLAN), and/or a cellular network, such as a long-term evolution (LTE) 3G, 4G, and/or 5G network. The network 208 may facilitate communication between the various distributed devices, in accordance with various wired or wireless communication protocols. Examples of such wired or wireless communication protocols or technical standards may include, but are not limited to, Bluetooth protocol, an infrared protocol, a Wireless Fidelity (Wi-Fi) protocol, a ZigBee protocol, IEEE 802.11, 802.11p, 802.15, 802.16, 1609, cellular communication protocols, a Near Field Communication (NFC) protocol, a Universal Serial Bus (USB) protocol, Transmission Control Protocol and Internet Protocol (TCP/IP), User Datagram Protocol (UDP), Long-term Evolution (LTE) protocols, voice over Internet Protocol (VoW), and/or a wireless USB protocol.

The above embodiment is one of the many distributed configurations of the circuitry of the multi-microphone system 100 in the network environment 200. Although described herein with reference to the distributed configuration of the circuitry of the multi-microphone system 100 in the network environment 200 in FIG. 2, the present disclosure contemplates that other distributed configurations of the circuitry of the multi-microphone system 100 in the network environment 200 may be equally applicable, without variation in the scope of the disclosure. The operational aspect of the various devices as illustrated in FIG. 2 has been described in FIGS. 4-7.

FIGS. 3A and 3B, collectively illustrate a schematic diagram of a voice product, such as a headset apparatus 300, according to one or more embodiments of the present disclosure. FIGS. 3A and 3B are described in conjunction with FIGS. 1-2. In an example embodiment, as illustrated in FIGS. 3A and 3B, the voice product is a headset apparatus 300 that may include a wireless enabled voice recognition device that utilizes a hands-free profile.

FIG. 3A illustrates a schematic perspective diagram of the headset apparatus 300, in accordance with an embodiment of the disclosure. The headset apparatus 300 includes a headband 302 (designed to fit on a user's head, in an ear, over an ear, or otherwise designed to support the headset apparatus 300) and a pair of earpieces 304, one of the earpieces 304 securing a boom unit 306. The boom unit 306 may include a boom arm 308, upon which is mounted multiple microphones, such as the plurality of microphone units 102. The plurality of microphone units 102 may be covered with a removable microphone windscreen 310. User controls 312, which may be coupled with a user interface of an associated user device, such as a desktop, may also be located on the outer cover of one of the pair of earpieces 304.

FIG. 3A illustrates one embodiment of the headset apparatus 300 for incorporating embodiments of the present disclosure. For example, the headset apparatus 300 may be utilized to incorporate a wireless voice-enabled terminal as discussed herein, as one aspect of the disclosure. Alternatively, the headset apparatus 300 may also be utilized as a stand-alone headset that is coupled wired or wirelessly to a separate portable or mobile voice terminal that is appropriately worn, such as on the waist of a user that is using the headset apparatus 300.

With reference to FIG. 3B, a detailed illustration of the right earpiece of the pair of earpieces 304 that secures the boom unit 306 is shown. The right earpiece includes at least a housing 314 which may house various components, such as a speaker 316, and secures the boom unit 306. The boom unit 306 may be rotatably mounted with the housing 314 and may include the user controls 312 and the plurality of microphone units 102, positioned at the lower end of the boom unit 306. A circuit board 318 may further be supported in the housing 314 for use by the speaker 316. The circuit board 318 may contain one or more of the electronic components, such as the controller 114, illustrated for the circuitry of the multi-microphone system 100, as described in FIG. 1 above. In an example embodiment, the circuit board 318 may include all of the operational electronics of the circuitry of the multi-microphone system 100. Alternatively, there may be an additional circuit board in a power source/electronics assembly in addition to a battery pack of the headset apparatus 300. Also positioned on the circuit board 318 may be an antenna (not shown) for the WLAN radio to transmit/receive frequencies associated with an 802.11 standard, for example. The antenna may be located and configured to minimize RF transmissions to the head of the user. There is further shown one section of boom housing 320A that cooperates with another section of boom housing 320B in a clamshell fashion to capture the circuit board 318 and an anchor structure 322 for the boom arm 308.

In an example embodiment, the headset apparatus 300 may include an electronic module (not shown) in which various elements may be incorporated rather than the headset apparatus 300, to reduce the weight of the headset apparatus 300. For example, one or more of a rechargeable or long life battery, display, keypad, Bluetooth® antenna, and printed circuit board assembly (PCBA) electronics may be included in the electronics module and/or otherwise incorporated into the headset apparatus 300.

One or more components of the circuitry of the multi-microphone system 100 may also be implemented in the electronic module and/or the headset apparatus 300. The electronics module may be remotely coupled to the lightweight and comfortable headset apparatus 300 secured to a worker head via the headband 302. In the embodiment illustrated in FIG. 3A, the headset apparatus 300 may be attached to the electronics module, via a communication link such as a small audio cable, but could instead communicate with the electronics module via a wireless link. In an embodiment, the headset apparatus 300 may have a low profile and be minimalistic in appearance.

In an example embodiment (not shown), except for one microphone unit, remaining microphone units of the plurality of microphone units 102 and the controller 114 may be located in different computing devices in a distributed manner, as illustrated in FIG. 2. In such an embodiment, the remaining microphone units of the plurality of microphone units 102 and the controller 114 may be located in different computing devices that may be remotely coupled to the headset apparatus 300, via a network, such as the network 208. Various configurations may be used without deviating from the scope of the present disclosure.

Although FIGS. 3A and 3B illustrate one example of the headset apparatus, various changes may be made to FIGS. 3A and 3B. Various components may be combined, subdivided, and/or omitted and additional components may be added according to particular needs without deviation from the scope of the present disclosure. The operational aspect of the headset apparatus 300 as illustrated in FIGS. 3A and 3B has been described in FIGS. 4-7.

FIGS. 4-7 illustrate flowcharts describing operations of a multi-microphone method in a multi-microphone system to output a sound signal, according to one or more embodiments of the present disclosure. It will be understood that each block of the flowcharts, and combinations of blocks in the flowcharts, may be implemented by various means, such as hardware, firmware, one or more processors, circuitry and/or other devices associated with execution of software including one or more computer program instructions. For example, one or more of the procedures described above may be embodied by computer program instructions. In this regard, the computer program instructions which embody the procedures described above may be stored by a memory of an apparatus employing an embodiment of the present disclosure and executed by a processor in the apparatus. As will be appreciated, any such computer program instructions may be loaded onto a computer or other programmable apparatus (such as, hardware) to produce a machine, such that the resulting computer or other programmable apparatus provides for implementation of the functions specified in the flowcharts' block(s). These computer program instructions may also be stored in a non-transitory computer-readable storage memory that may direct a computer or other programmable apparatus to function in a particular manner, such that the instructions stored in the computer-readable storage memory produce an article of manufacture, the execution of which implements the function specified in the flowcharts' block(s). The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowcharts' block(s). As such, the operations of FIGS. 4-7 when executed, convert a computer or processing circuitry into a particular machine configured to perform an example embodiment of the present disclosure. Accordingly, the operations of FIGS. 4-7 define algorithms for configuring a computer or processor, to perform an example embodiment. In some cases, a general purpose computer may be provided with an instance of the processor which performs the algorithms of FIGS. 4-7 to transform the general purpose computer into a particular machine configured to perform an example embodiment.

Accordingly, blocks of the flowchart support combinations of means for performing the specified functions and combinations of operations for performing the specified functions. It will also be understood that one or more blocks of the flowcharts, and combinations of blocks in the flowchart, may be implemented by special purpose hardware-based computer systems which perform the specified functions, or combinations of special purpose hardware and computer instructions.

FIG. 4 illustrates a flowchart depicting method for outputting a sound signal from a multi-microphone system, such as those described above with reference to FIGS. 1-3B. In this regard, in an example embodiment, various operations illustrated in reference to FIG. 4 may, for example, be performed by, with the assistance of, and/or under the control of the circuitry of the multi-microphone system 100 embodying at least the plurality of microphone units 102 and the controller 114.

Turning to operation 402, the multi-microphone system 100 includes means, such as the plurality of transducers 104 in the plurality of microphone units 102, for receiving input sound signals. In an example embodiment, the plurality of transducers 104 may be configured to receive the input sound signal 122 from a sound source located in an ambient environment. The plurality of transducers 104 may be further configured to receive noise signals from the ambient environment where the sound source is located (e.g., sound other than the intended input sound signal). In an example embodiment, the sound source may correspond to a speech input provided by a user that handles the voice product 206 or wears the headset apparatus 300. In another embodiment, the sound source may correspond to recorded voice samples played by a playback device (not shown) in a vicinity of the plurality of microphone units 102, as illustrated in FIG. 1, or one or more microphone units 212A (in the first electronic device 202) and a microphone unit 212B (in the voice product 206), as illustrated in FIG. 2. For example, in some embodiments, the voice product 206 (FIG. 2) or the headset apparatus 300 (FIGS. 3A and 3B) may be utilized by the user in a warehouse or an inventory store while performing various tasks, such as picking and placing of commodities at various locations within the warehouse. In these instances, the user within the warehouse may provide voice commands over the voice product 206 or the headset apparatus 300 (e.g., indicating locations, shelf number, aisle number, or bin number where a product is placed). Thus, in addition to the input sound signal 122 (that corresponds to the voice commands of the user), noise signals from the background may also be received by the plurality of transducers in the plurality of microphone units 102.

Turning to operation 404, the multi-microphone system 100 includes means, such as the plurality of transducers 104, the plurality of amplifiers 106, and the plurality of ADCs in the plurality of microphone units 102, for generating a plurality of sound signal outputs. In an embodiment, with reference to FIGS. 3A and 3B, the plurality of microphone units 102 may be located within a single apparatus, such as the headset apparatus 300. In another embodiment, with reference to FIG. 2, the plurality of microphone units 102 may be distributed in a network environment, such as the network environment 200. In such an embodiment, the one or more microphone units 212A may be located within the first electronic device 202, and the microphone unit 212B may be located within the voice product 206. Thus, the one or more microphone units 212A and the microphone unit 212B may collectively realize the plurality of microphone units 102 over the distributed network environment 200. Here, the first electronic device 202 and the voice product 206 may be remotely communicatively coupled with each other via the first communication module 210A and the third communication module 210C, respectively, through the network 208.

Each of the plurality of transducers 104 in the plurality of microphone units 102 is operable within a sensitivity range such that each transducer has a different sensitivity range than other transducers of the plurality of transducers 104. For example, with reference to FIG. 1, the sensitivity ranges of the first transducer 104A, the second transducer 104B, the third transducer 104C, and the fourth transducer 104D, may be "R1", "R2", "R3", and "R4", respectively. Further, the sensitivity ranges "R1", "R2", "R3", and "R4" are in a decreasing order. In other words, in an exemplary embodiment the sensitivity range "R1" is the highest sensitivity, the sensitivity range "R2" is lower than the sensitivity range "R1" but higher than the sensitivity range "R3", the sensitivity range "R3" the lower than the sensitivity range "R2" but higher than the sensitivity range "R4", and the sensitivity range "R4" is the lowest sensitivity. In some embodiments, a sensitivity range, such as "R1", of one transducer, such as the first transducer 104A, in one microphone unit, such as the first microphone unit 102A, may overlap with a sensitivity range, such as "R2", of next less sensitive transducer, such as the second transducer 104B, in another microphone unit, such as the second microphone unit 102B. As described herein, the arrangement of the sensitivity ranges of the plurality of transducers 104 is in the decreasing order "R1", "R2", "R3", and "R4" is for exemplary purposes and should not be read to limit the scope of the present disclosure.

In an example embodiment, the sensitivity range of a transducer may be due to a configuration of a membrane of each transducer of the plurality of transducers 104. In another embodiment, for each transducer of the plurality of transducers 104, the sensitivity range may be due to a capacitive gap between the transducer and a back-plate of a substrate of the transducer. The present disclosure contemplates that there may be other factors on which the sensitivity range of each transducer is based upon, without deviation from the scope of the present disclosure.

Based on each respective sensitivity range, each transducer in a corresponding microphone unit may be configured to convert air pressure variations of a sound wave of the input sound signal 122 and noise signals to corresponding to a low-power electrical signal as described above. In an embodiment, the low-power electrical signal generated by each transducer, in conjunction with an associated ASIC unit, may be a pulse density modulation (PDM) stream. However, the present disclosure contemplates that the low-power electrical signal generated by each transducer may correspond to other types of modulation streams without deviating from the scope of the present disclosure.

In an instance in which one or more signal characteristics of the electrical signal exceed the sensitivity range of a corresponding transducer, the transducer may perform signal clipping of the electrical signal. For example, the low-power electrical signal of the transducer may be a clipped electrical signal resulting in distortion and quality degradation of the electrical signal. However, as each transducer in the plurality of transducers has a different sensitivity range, each transducer may be configured to generate low-power electrical signals with different levels of signal clipping, such that different levels of distortion are received for the same input signal. Consequently, the digital signals, "D1", "D2", "D3", and "D4", generated by the first microphone unit 102A, the second microphone unit 102B, the third microphone unit 102C, and the fourth microphone unit 102D, respectively, may have different distortion levels due to their different sensitivity ranges "R1", "R2", "R3", and "R4".

Based on respective sensitivity ranges, each transducer in a corresponding microphone unit may be configured to convert air pressure variations of a sound wave of the input sound signal 122 and noise signals to a corresponding to a low-power electrical signal and communicate the electrical signal to the corresponding amplifier. Each amplifier may be configured to amplify the low-power electrical signal to a defined power level for communication to the corresponding ANC module. Each ANC module may be configured to analyze the amplified electrical signal and create a destructive interference to reduce the volume of the perceivable noise in the amplified electrical signal. Thus, each ANC module cancels the noise signals and communicates the filtered amplified electrical signal to corresponding ADC. Each ADC may be configured to receive the noise-free electrical signal from the corresponding ANC module and generate a corresponding sound signal output that in some embodiments may be a digital signal.

In various embodiments, the plurality of generated digital signals may be represented as an 8-bit (256 levels), 16-bit (65,536 levels), 24-bit (16.8 million levels) and/or 32-bit (4.3 billion levels) representation. For example, the digital signal generated by the first ADC 110A, the second ADC 110B, the third ADC 110C, and the fourth ADC 110D, of the respective first microphone unit 102A, the second microphone unit 102B, the third microphone unit 102C, and the fourth microphone unit 102D may be, "D1", "D2", "D3", and "D4", respectively. Here, in accordance with an embodiment, each of the digital signals "D1", "D2", "D3", and "D4" may be assumed to be represented by 8-bits. The first microphone unit 102A, the second microphone unit 102B, the third microphone unit 102C, and the fourth microphone unit 102D may be configured to communicate respective sound signal outputs, that is the digital signals, "D1", "D2", "D3", and "D4", to the controller 114.

Turning to operation 406, the multi-microphone system 100 includes means, such as the controller 114, for iteratively receiving sound signal outputs from each of the plurality of microphone units 102, each comprising respective transducers of decreasing sensitivity. In an exemplary embodiment, the controller 114 may be configured to receive sound signal output, for example the digital signal "D1", from the first microphone unit 102A of the plurality of microphone units 102, as the sensitivity range "R1" of the first transducer 104A is the highest sensitivity range amongst the plurality of transducers 104. Although described herein with reference to FIG. 4 that the sensitivity range "R1" of the first transducer 104A is the highest, the present disclosure contemplates that sensitivity range of another transducer of the plurality of transducers 104 may be the highest, without deviation from the scope of the disclosure.

In an embodiment, with reference to FIGS. 3A and 3B, the controller 114 may be located within the same apparatus as of the plurality of microphone units 102, such as the headset apparatus 300. In another embodiment, with reference to FIG. 2, the controller 114 may be located within the second electronic device 204 in the distributed network environment 200. Here, the first electronic device 202, the second electronic device 204, and the voice product 206 may be remotely communicatively coupled with each other via the first communication module 210A, second communication module 210B, and the third communication module 210C, respectively, through the network 208.

Turning to operation 408, the multi-microphone system 100 includes means, such as the controller 114, for analyzing the received sound signal output of the first microphone unit 102A to identify a first parameter of the received sound signal output. The first parameter may correspond to at least one of a signal clipping parameter of the first microphone unit 102A, a difference between a signal amplitude received by the first transducer 104A of the first microphone unit 102A and a midpoint of the sensitivity range of the first transducer 104A of the first microphone unit 102A, or the dBFS level of the sound signal output of the first microphone unit 102A. The detailed operations for identifying the first parameter of the received sound signal output are described in the flowcharts 500A, 500B, and 500C of FIGS. 5A, 5B, and 5C, respectively.

Figure 5A:
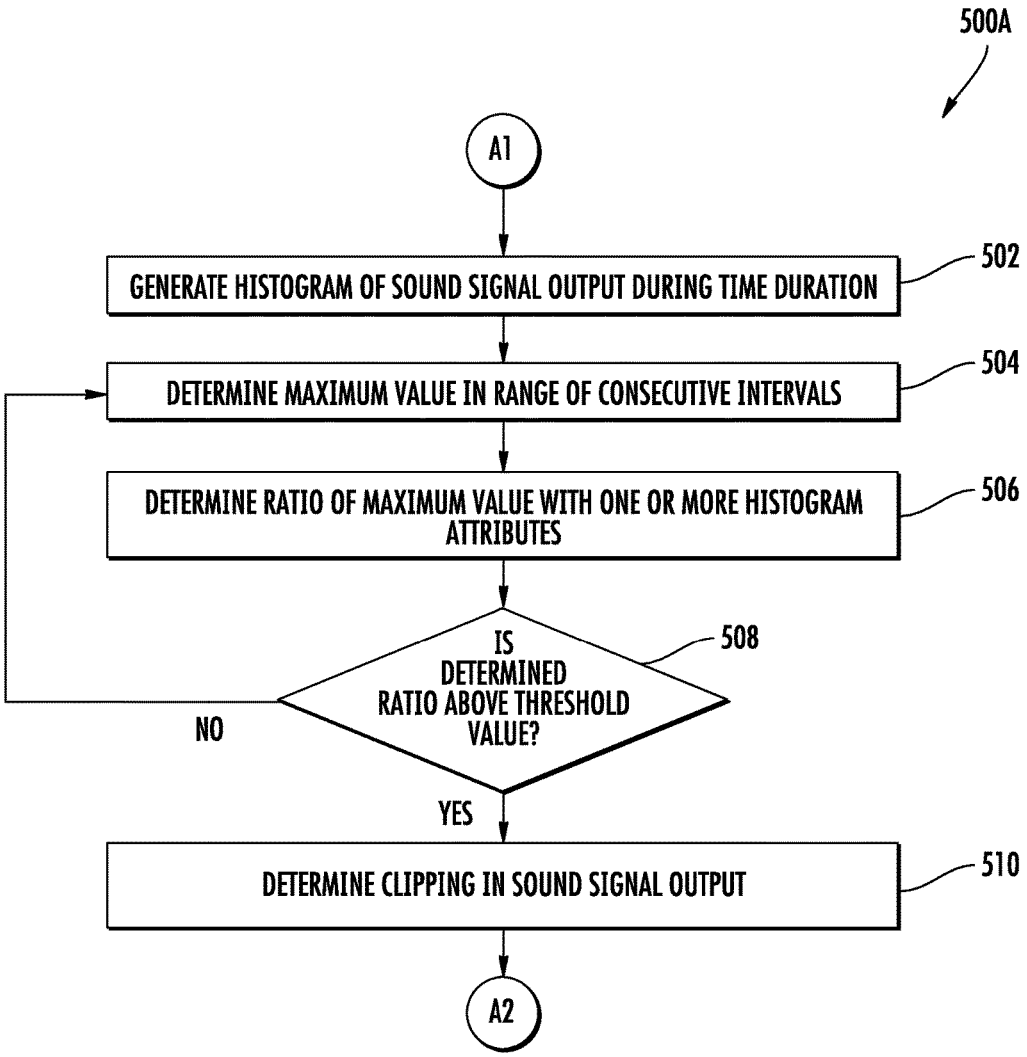
FIGS. 5A-5C illustrate flowcharts depicting methods for determining a parameter of a received sound signal output based on various techniques, according to one or more embodiments of the present disclosure described herein.

In an exemplary embodiment, as described in the flowchart 500A of FIG. 5A, the first parameter may correspond to a signal clipping parameter, "C1". The signal clipping parameter "C1" may be determined based on one or more clipping/distortion detection techniques, known in the art. In accordance with a non-limiting exemplary audio clipping technique, a graphical representation, such as a histogram H(x), may be generated for the input sound signal 122. In a range of "N" bins of the histogram (i.e. amplitude intervals), a local maximum may be determined. The local maximum may be compared with at least one of a histogram value of a neighboring bin or a histogram value of a bin outside of the range of bins. Based on the comparison, the controller 114 may be configured to determine the signal clipping parameter "C1" corresponding to the received sound signal parameter for the input sound signal 122.

In an instance, the determined signal clipping parameter, "C1", of the first microphone unit 102A may indicate a distortion level of the digital signal, "D1", such that a zero value of the signal clipping parameter, "C1", corresponds to an instance in which the digital signal, "D1", of the first microphone unit 102A is not clipped. In another instance, the signal clipping parameter, "C1", of the first microphone unit 102A may indicate a distortion level of the digital signal, "D1", such that a non-zero value of the signal clipping parameter, "C1", of the first microphone unit 102A corresponds to an instance in which the digital signal, "D1", of the first microphone unit 102A is clipped.

Figure 5B:
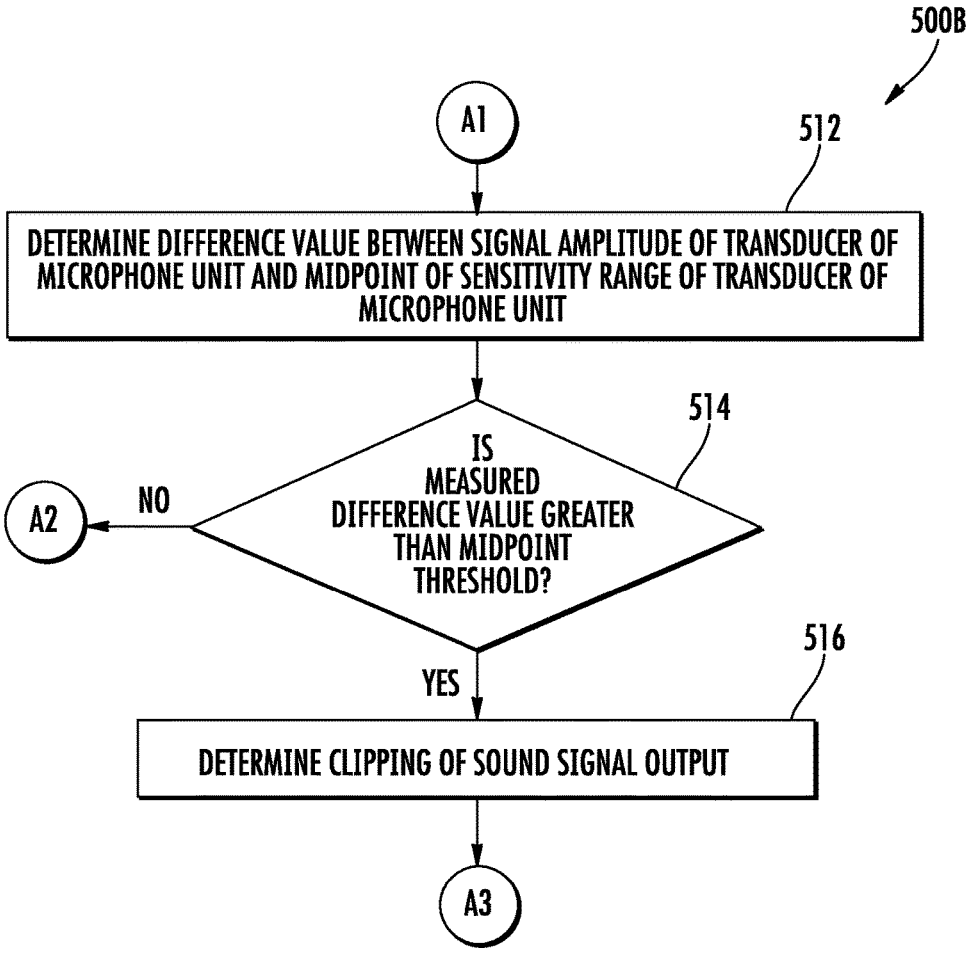

In another exemplary embodiment, as described in the flowchart 500B of FIG. 5B, the first parameter may correspond to a difference between a signal amplitude "A1" received by the first transducer 104A of the first microphone unit 102A and a midpoint of the sensitivity range "R1" of the first transducer 104A of the first microphone unit 102A. The controller 114 may analyze the digital signal, "D1", of the first microphone unit 102A to determine the difference value between a signal amplitude "A1" received by the first transducer 104A of the first microphone unit 102A and a midpoint of the sensitivity range "R1" of the first transducer 104A of the first microphone unit 102A. In an instance, the difference value (i.e. "A1−midpoint (R1)"), of the first microphone unit 102A may indicate a distortion level of the digital signal, "D1", such that a difference value of zero corresponds to an instance in which the digital signal, "D1", of the first microphone unit 102A is not clipped. In another instance, the difference value (i.e. "A1−midpoint (R1)"), of the first microphone unit 102A may indicate a distortion level of the digital signal, "D1", such that a positive value corresponds to an instance in which the digital signal, "D1", of the first microphone unit 102A is clipped (e.g., above a midpoint threshold).

Figure 5C:
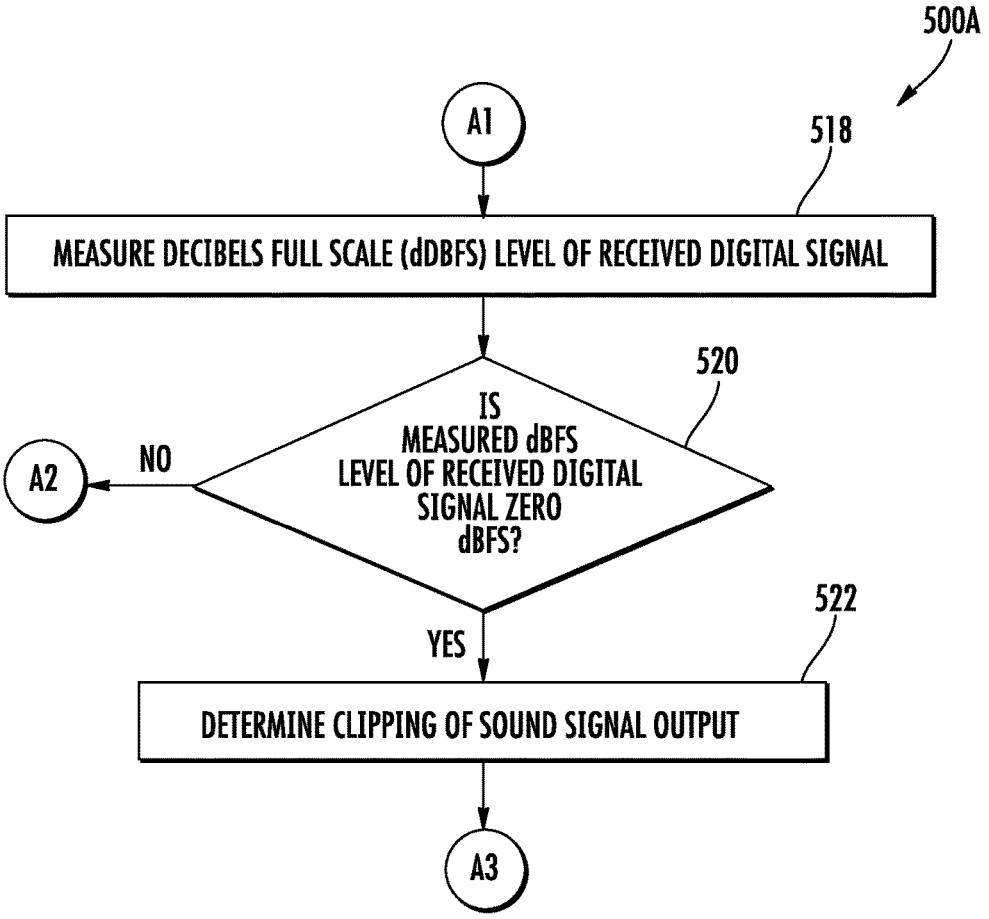

In yet another exemplary embodiment, as described in the flowchart 500C of FIG. 5C, the first parameter may correspond to a dBFS level of the sound signal output of the first microphone unit 102A. The controller 114 may analyze the digital signal, "D1", of the first microphone unit 102A to determine the dBFS level of the sound signal output of the first microphone unit 102A. In an instance, the dBFS level may indicate a distortion level of the digital signal, "D1", such that dBFS level of zero corresponds to an instance in which the digital signal, "D1", of the first microphone unit 102A is clipped. In another instance, the dBFS level may indicate a distortion level of the digital signal, "D1", such that dBFS level of non-zero corresponds to an instance in which the digital signal, "D1", of the first microphone unit 102A is not clipped.

In accordance with various embodiments, various operations, as described above, may be performed by the flowcharts 500A, 500B, and 500C of FIGS. 5A, 5B, and 5C, respectively to determine the first parameter of the sound signal output of each microphone unit of the plurality of microphone units 102, and the controller 114 returns to operation 410 in flowchart 400 of FIG. 4.

Turning to operation 410, the multi-microphone system 100 includes means, such as the controller 114, for determining whether parameter of the received sound signal output of a microphone unit, such as the first microphone unit 102A, satisfies one or more pre-defined criteria. In an embodiment, the first parameter satisfies the one or more pre-defined criteria in an instance in which the sound signal output of the first microphone unit 102A is not clipped. In another embodiment, the first parameter satisfies the one or more pre-defined criteria in an instance in which the sound signal output is outside of sensitivity ranges of transducers of remaining microphone units, i.e. the second microphone unit 102B, the third microphone unit 102C, and the fourth microphone unit 102D, of the plurality of microphone units 102 with lower sensitivity ranges, i.e. "R2", "R3", and "R4".

In an example embodiment, when the controller 114 determines that the first microphone unit 102A from amongst the plurality of microphone units 102 having the first parameter satisfying the one or more pre-defined criteria, the controller 114 passes to operation 412. In such embodiment, the first microphone unit 102A may be referred to as a microphone unit that is not overdriven. In an alternative embodiment, when the controller 114 determines that the first microphone unit 102A from amongst the plurality of microphone units 102 having the first parameter failing to satisfy the one or more pre-defined criteria, the controller 114 passes to operation 602 in the flowchart 600. In such embodiment, the first microphone unit 102A may be referred to as a microphone unit that is overdriven.

Turning to operation 412, the multi-microphone system 100 includes means, such as the controller 114 in the multi-microphone system 100, for selecting the first microphone unit 102A for which the first parameter satisfies the one or more pre-defined criteria. In such a case, the first microphone unit 102A may be referred to as not overdriven. Accordingly, based on the selection, the controller 114 may be configured to set the selected first microphone unit 102A as an active unit.

Once the controller 114 sets a selected microphone unit, such as the first microphone unit 102A, as an active microphone unit, the controller 114 generates an N-bit or multi-byte representation, such as the 32-bit representation of the output of the plurality of microphone units 102. For example, with reference to FIG. 1, in the 32-bit representation, bits 0-7 may be designated for the digital signal "D1" generated by the first microphone unit 102A, bits 8-15 may be designated for the digital signal "D2" generated by the second microphone unit 102B, bits 16-23 may be designated for the digital signal "D3" generated by the third microphone unit 102C, and the bits 24-31 may be designated for the digital signal "D4" generated by the fourth microphone unit 102D. In other words, the N-bit or multi-byte representation comprises one or more first sets of bits and one or more second sets of bits. The one or more first sets of bits, such as bits 0-7, in the N-bit or multi-byte representation may correspond to sound signal outputs of a first set of microphone units (i.e. the first microphone unit 102A) with sensitivity ranges equal to or greater than the sensitivity range, such as "R1", of the selected microphone unit, such as the first microphone unit 102A. The one or more second sets, such as bits 8-15, bits 16-23, and bits 24-31, of bits in the N-bit or multi-byte representation may correspond to sound signal outputs of a second set of microphone units (i.e. the second microphone unit 102B, the third microphone unit 102C, and the fourth microphone unit 102D) with sensitivity ranges less than the sensitivity range, such as "R1", of the selected microphone unit, such as the first microphone unit 102A. In an embodiment, the one or more second sets of bits in the N-bit or multi-byte representation may be set to zero. In accordance with the above example, the first 8 bits of a 32-bit representation may correspond to sound signal output of the first microphone unit 102A. The rest of the 24 bits of the 32-bit representation may be set to zero to avoid noise in less sensitive microphone units, such as the second microphone unit 102B, the third microphone unit 102C, and the fourth microphone unit 102D, masking the actual signal in more sensitive microphone unit, i.e. the first microphone unit 102A.

In an alternate embodiment, once the controller 114 sets a selected microphone unit as an active microphone unit, an additional hardware component, such as a combiner (not shown in FIG. 1), may be configured to combine the digital signals, "D1", "D2", "D3", and "D4", and generate a combined representation, i.e. the N-bit or multi-byte representation, of the digital signals. In an embodiment, the combiner may be integrated into the controller 114, and consequently, the N-bit or the multi-byte representation may be generated by the controller 114.

Turning to operation 414, the multi-microphone system 100 includes means, such as the controller 114 in the multi-microphone system 100, for outputting the sound signal output of the selected first microphone unit 102A as the output of the multi-microphone system 100. The controller 114 may thereafter pass to operation 702 in flowchart 700 of FIG. 7.

FIGS. 5A, 5B, and 5C illustrate flowcharts depicting methods for determining a parameter of a received sound signal output based on a first technique, according to one or more embodiments of the present disclosure described herein. Specifically, FIG. 5A illustrates a flowchart describing operations for determining a signal clipping parameter, according to one or more embodiments of the present disclosure. In this regard, in an example embodiment, various operations illustrated with reference to FIG. 5A may, for example, be performed by, with the assistance of, and/or under the control of the circuitry of the multi-microphone system 100 embodying at least the plurality of microphone units 102 and the controller 114. The flowchart 500A of FIG. 5A is described in conjunction with the flowchart 400 of FIG. 4. Specifically, operation 502 of the flowchart 500A may be initiated during operation 408 of the flowchart 400 for determination of the signal clipping parameter of a microphone unit.

Turning to operation 502, the multi-microphone system 100 includes means, such as the controller 114 in the multi-microphone system 100, for generating a histogram of a sound signal output of a microphone unit, such as the first microphone unit 102A, during a specified time duration. The generated histogram may comprise a plurality of ranges (corresponding to the sound signal output) of nonoverlapping and consecutive intervals, referred to as bins.

Turning to operation 504, the multi-microphone system 100 includes means, such as the controller 114 in the multi-microphone system 100, for determining maximum value in the ranges of consecutive intervals of the generated histogram. The determined maximum value may be determined based on local maxima in the ranges of consecutive intervals of the generated histogram that correspond to the sound signal output of the first microphone unit 102A.

Turning to operation 506, the multi-microphone system 100 includes means, such as the controller 114 in the multi-microphone system 100, for determining ratio of maximum value with one or more histogram attributes, such as histogram values of neighbor bins or local averages.

Turning to operation 508, the multi-microphone system 100 includes means, such as the controller 114 in the multi-microphone system 100, for determining whether the ratios exceed a threshold value. In an embodiment, when the ratios exceed the threshold value, control turns to operation 508. Alternatively, when the ratios fail to exceed the threshold value, control turns back to operation 504.

Turning to operation 510, the multi-microphone system 100 includes means, such as the controller 114 in the multi-microphone system 100, for determining extent of clipping in the sound signal output of the first microphone unit 102A, based on the ratio of maximum value with one or more histogram attributes. Control turns back to operation 410 in flowchart 400 of FIG. 4.

FIG. 5B illustrates a flowchart describing operations for determining a signal clipping parameter based on a second technique, according to one or more embodiments of the present disclosure. In this regard, in an example embodiment, various operations illustrated with reference to FIG. 5B may, for example, be performed by, with the assistance of, and/or under the control of the circuitry of the multi-microphone system 100 embodying at least the plurality of microphone units 102 and the controller 114. The flowchart 500B of FIG. 5B is described in conjunction with the flowchart 400 of FIG. 4. Specifically, operation 512 of the flowchart 500B may be initiated during operation 408 of the flowchart 400 for determination of the signal clipping parameter of each microphone unit.

Turning to operation 512, the multi-microphone system 100 includes means, such as the controller 114 in the multi-microphone system 100, for determining a difference between a signal characteristic, such as signal amplitude, of a sound signal received by a transducer, such as the first transducer 104A, of the microphone unit, such as the first microphone unit 102A, and midpoint of sensitivity range "R1" of the first transducer 104A of the first microphone unit 102A.

For example, the signal amplitude of the sound signal received by the first transducer 104A of the first microphone unit 102A may be "A1", and a midpoint of the sensitivity range "R1" of the first transducer 104A of the first microphone unit 102A may be "midpoint (R1)". The controller 114 may determine the difference value between the signal amplitude "A1" of the sound signal received by the first transducer 104A of the first microphone unit 102A and a midpoint of the sensitivity range "midpoint (R1)" of the first transducer 104A of the first microphone unit 102A.

Turning to operations 512 and 514, the multi-microphone system 100 includes means, such as the controller 114 in the multi-microphone system 100, for determining whether the difference value is greater than a midpoint threshold. In an embodiment, the difference value (i.e. "A1−midpoint (R1)"), of the first microphone unit 102A may be zero or less than zero and corresponds to an instance in which the digital signal, "D1", of the first microphone unit 102A is not clipped (e.g., less than the midpoint threshold). The control turns to operation 410 in flowchart 400 of FIG. 4.

In an alternate embodiment, the difference value (i.e. "A1−midpoint (R1)"), of the first microphone unit 102A may be a positive value that corresponds to an instance in which the digital signal, "D1", of the first microphone unit 102A is clipped (e.g., greater than the midpoint threshold). The control turns to operation 516.

Turning to operation 512, the multi-microphone system 100 includes means, such as the controller 114 in the multi-microphone system 100, for determining clipping of sound signal output. The control turns back to operation 410 in flowchart 400 of FIG. 4.

FIG. 5C illustrates a flowchart describing operations for determining a signal clipping parameter based on a third technique, according to one or more embodiments of the present disclosure. In this regard, in an example embodiment, various operations illustrated with reference to FIG. 5C may, for example, be performed by, with the assistance of, and/or under the control of the circuitry of the multi-microphone system 100 embodying at least the plurality of microphone units 102 and the controller 114. The flowchart 500C of FIG. 5C is described in conjunction with the flowchart 400 of FIG. 4. Specifically, operation 518 of the flowchart 500C may be initiated during operation 408 of the flowchart 400 for determination of the signal clipping parameter of each microphone unit.

Turning to operation 518, the multi-microphone system 100 includes means, such as the controller 114 in the multi-microphone system 100, for measuring a dBFS level of a digital signal. In an example embodiment, the controller 114 may be configured to measure the dBFS level of the digital signal "D1" to determine the corresponding distortion level of the digital signal "D1" generated by the first microphone unit 102A. As would be evident to one of ordinary skill in the art in light of the present disclosure, a dBFS level corresponds to the decibel amplitude level of a digital signal.

Turning to operation 520, the multi-microphone system 100 includes means, such as the controller 114 in the multi-microphone system 100, for determining whether the measured peak level of the digital signal "D1" is zero dBFS. This may indicate that the signal clipping parameter value of the determined signal clipping parameter of a microphone unit is a positive signal clipping parameter value indicating a distortion level of the respective sound signal output of corresponding microphone unit. For such embodiment, the controller 114 turns to operation 522. For example, the controller 114 may measure the peak level of the digital signals, "D1" to be zero dBFS. For such an embodiment, the controller 114 turns to operation 522. In alternate embodiment, the controller 114 may determine that the measured peak level of the received digital signals is non-zero dBFS. For example, the controller 114 may measure the peak level of the digital signal "D1" to be non-zero dBFS. This may indicate that the signal clipping parameter value of the determined signal clipping parameter of a microphone unit is zero indicating no distortion of the respective sound signal output of each of the plurality of microphone units. For such an embodiment, the controller 114 turns back to operation 410.

Turning to operation 522, the multi-microphone system 100 includes means, such as the controller 114 in the multi-microphone system 100, for determining the clipping of the digital signal "D1". In an embodiment, the controller 114 may be configured to determine that the digital signal "D1" has been clipped as the peak level of the digital signal "D1" is determined to be zero dBFS. The controller 114 may then pass to operation 410 in flowchart 400 of FIG. 4.

FIG. 6 illustrates a flowchart depicting a method for switching to a second microphone unit (i.e. another microphone unit), according to one or more embodiments of the present disclosure. In this regard, in an example embodiment, various operations illustrated in reference to FIG. 6 may, for example, be performed by, with the assistance of, and/or under the control of the circuitry of the multi-microphone system 100 embodying at least the plurality of microphone units 102 and the controller 114. The flowchart 600 of FIG. 6 is described in conjunction with the flowchart 400 of FIG. 4. Specifically, operation 602 of the flowchart 600 may be initiated after operation 410 of the flowchart 400.

At operation 410, it was described that the multi-microphone system 100 includes means, such as the controller 114 in the multi-microphone system 100, for determining whether parameter of the sound signal output of the microphone, such as the first microphone unit 102A, during operation 410 in FIG. 4, satisfies the one or more pre-defined criteria, after a specified time interval.

In an example embodiment, the specified time interval, such as "10 milliseconds", may be preset by the controller 114. The controller 114 may be configured to determine whether the first parameter of the sound signal output of the first microphone unit 102A meets the one or more pre-defined criteria after the specified time interval. For example, the controller 114 may determine whether the signal clipping parameter "C1" of the sound signal output, such as the digital signal "D1", meets the one or more pre-defined criteria after "10 milliseconds". In another embodiment, the controller 114 may be configured to determine whether the first parameter of the sound signal output of the first microphone unit 102A meets the one or more pre-defined criteria on an occurrence of an event. The event may correspond to, but not limited to, detection of change of the network environment of the circuitry of the multi-microphone system 100, detection of a change of one or more characteristics of the input sound signal 122, or the like.

In an example embodiment, when the controller 114 determines that the first parameter of the sound signal output of the first microphone unit 102A meets the one or more pre-defined criteria after the specified time interval or at the occurrence of the event, the control turns to operation 412 in flowchart 400. Accordingly, the same microphone unit, that is the first microphone unit 102A, will be selected to output the corresponding sound signal and will remain activated. In alternative embodiment, when the controller 114 determines that the first parameter of the sound signal output of the first microphone unit 102A fails to meet the one or more pre-defined criteria after the specified time interval or at the occurrence of the event, the controller 114 turns to operation 602.

Turning to operation 602, the multi-microphone system 100 includes means, such as the controller 114 in the multi-microphone system 100, for receiving sound signal output, for example the digital signal "D2", from the second microphone unit 102B of the plurality of microphone units 102, as the sensitivity range "R2" of the second transducer 104B is next to the sensitivity range "R1" of the first transducer 104A of the plurality of transducers 104.

Turning to operation 604, the multi-microphone system 100 includes means, such as the controller 114 in the multi-microphone system 100, for analyzing received sound signal output of the second microphone unit 102B to identify the second parameter of the received sound signal output. The second parameter, in a similar manner to the first parameter of the first microphone unit 102A in FIG. 4, may correspond to at least one of a signal clipping parameter of the second microphone unit 102B, a difference value between a signal amplitude received by the second transducer 104B of the second microphone unit 102B and a midpoint of the sensitivity range of the second transducer 104B of the second microphone unit 102B, or the dBFS level of the sound signal output of the second microphone unit 102B. The detailed operations for identifying the second parameter of the received sound signal output are described in the flowcharts 500A, 500B, and 500C of FIGS. 5A, 5B, and 5C, respectively.

Turning to operation 606, the multi-microphone system 100 includes means, such as the controller 114, for determining whether the second parameter of the received sound signal output of the second microphone unit 102B satisfies one or more pre-defined criteria. In an embodiment, the second parameter satisfies the one or more pre-defined criteria in an instance in which the sound signal output of the second microphone unit 102B is not clipped. In another embodiment, the second parameter satisfies the one or more pre-defined criteria in an instance in which the sound signal output being outside of sensitivity ranges of transducers of remaining microphone units, i.e. the third microphone unit 102C and the fourth microphone unit 102D, of the plurality of microphone units 102 with lower sensitivity ranges, i.e. "R3" and "R4".

In an example embodiment, when the controller 114 determines that the second microphone unit 102B from amongst the plurality of microphone units 102 having the second parameter satisfying the one or more pre-defined criteria, the controller 114 turns to operation 608. In such embodiment, the second microphone unit 102B may be referred to as a microphone unit that is not overdriven. In an alternative embodiment, when the controller 114 determines that the second microphone unit 102B from amongst the plurality of microphone units 102 having the second parameter failing to satisfy the one or more pre-defined criteria, the controller 114 turns to operation 612 in the flowchart 600.

Turning to operation 608, the multi-microphone system 100 includes means, such as the controller 114 in the multi-microphone system 100, for selecting the second microphone unit 102B for which the second parameter satisfies the one or more pre-defined criteria. In such a case, the second microphone unit 102B may be referred to be as not overdriven. Accordingly, based on the selection, the controller 114 may be configured to set the selected second microphone unit 102B as an active unit.

Once the controller 114 sets second microphone unit 102B as an active microphone unit, the controller 114 generates an N-bit or multi-byte representation, such as the 32-bit representation. As described above, the N-bit or multi-byte representation comprises one or more first sets of bits and one or more second sets of bits. The one or more first sets of bits in the N-bit or multi-byte representation may correspond to sound signal outputs of a first set of microphone units with sensitivity ranges equal to or greater than the sensitivity range, such as "R2", of the selected second microphone unit 102B. Thus, the one or more first set of bits may correspond to sound signal outputs of the first microphone unit 102A and the second microphone unit 102B. The one or more second sets of bits in the N-bit or multi-byte representation may correspond to sound signal outputs of a second set of microphone units with sensitivity ranges less than the sensitivity range, such as "R2", of the selected microphone unit, such as the second microphone unit 102B. Thus, the one or more second set of bits may correspond to sound signal outputs of the third microphone unit 102C and the fourth microphone unit 102D. In an embodiment, the one or more second sets of bits in the N-bit or multi-byte representation may be set to zero. In accordance with the above example, the first 16 bits of a 32-bit representation may correspond to sound signal outputs of the first microphone unit 102A and the second microphone unit 102B. Rest of the 16 bits of the 32-bit representation may be set to zero to avoid noise in less sensitive microphone units, such as the third microphone unit 102C and the fourth microphone unit 102D, masking the actual signal in more sensitive microphone unit, i.e. the second microphone unit 102B.

Turning to operation 610, the multi-microphone system 100 includes means, such as the controller 114 in the multi-microphone system 100, for outputting the sound signal output of the selected second microphone unit 102B as the output of the multi-microphone system 100.

In the example embodiment, the controller 114 switches to the second microphone unit 102B as the second parameter satisfies the one or more pre-defined criteria. For example, when the controller 114 selects the first microphone unit 102A as the most optimal microphone unit from amongst the plurality of microphone units 102, however after "10 milliseconds", the first microphone unit 102A is found to be overdriven, thus the controller 114 switches to the second microphone unit 102B which is not overdriven. Accordingly, initially the controller 114 outputs the digital signal "D1" of the optimal first microphone unit 102A as the output of the multi-microphone system 100, however after "10 milliseconds", the controller 114 outputs the digital signal "D2" of the optimal second microphone unit 102B as the output of the multi-microphone system 100. In this way, the controller 114 switches from the first microphone unit 102A to the second microphone unit 102B so that the output of the multi-microphone system 100 remains optimal. The controller 114 may thereafter turns to operation 702 in flowchart 700 of FIG. 7.

Turning to operation 612, the multi-microphone system 100 includes means, such as the controller 114 in the multi-microphone system 100, for iteratively receiving sound signal outputs from subsequent microphone units, each comprising respective transducers of decreasing sensitivity ranges when the controller 114 determines that the second microphone unit 102B from amongst the plurality of microphone units 102 having the second parameter failing to satisfy the one or more pre-defined criteria. For example, the controller 114 may receive sound signal output from the third microphone unit with the third transducer 104C of sensitivity range "R3" lower than the sensitivity range "R2" of the second microphone unit 102B. Thereafter, the controller 114 determines that the third microphone unit 102C is overdriven or not based on the comparison of the third parameter with the one or more pre-defined criteria. If the third microphone unit 102C is not overdriven, the controller 114 selects and activates the third microphone unit 102C and outputs the sound signal output of the selected third microphone unit 102C as the output of the multi-microphone system 100. However, if the third microphone unit 102C is overdriven, then the controller 114 receives sound signal output from the fourth microphone unit 102D with the fourth transducer 104D of sensitivity range "R4" lower than the sensitivity range "R3" of the third microphone unit 102C. Thus, the flowchart 600 repeats iteratively until a microphone unit with a transducer of a sensitivity range lower than the sensitivity range of the previous microphone unit and is not overdriven is determined. Once the controller 114 determines such a microphone unit, that microphone unit is selected, activated, and the corresponding sound signal is outputted as the output of the multi-microphone system 100.

Figure 7:
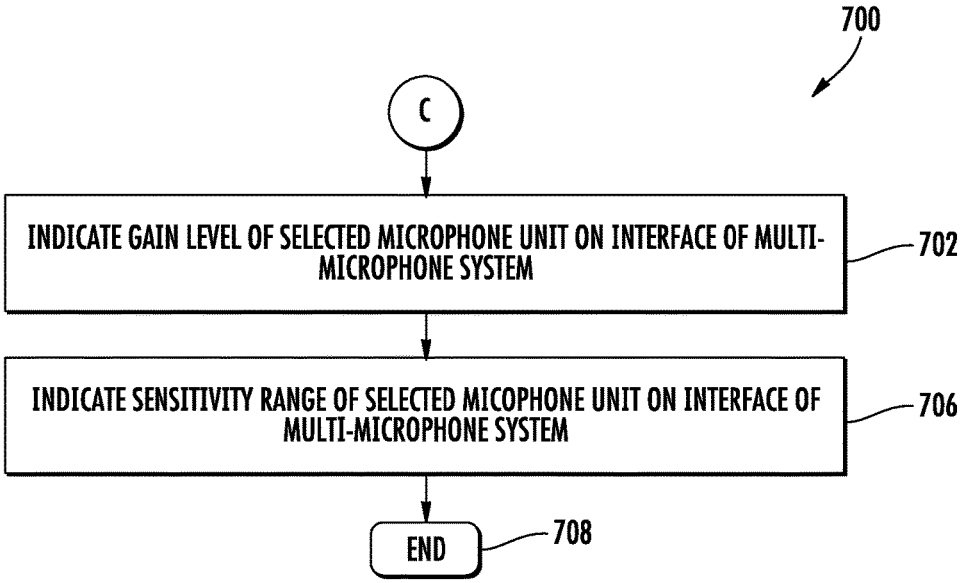
FIG. 7 illustrates a flowchart depicting a method for providing an indication of the selected microphone, according to one or more embodiments of the present disclosure described herein.

FIG. 7 illustrates a flowchart depicting a method for providing an indication of the selected microphone, according to one or more embodiments of the present disclosure. In this regard, in an example embodiment, various operations illustrated with reference to FIG. 7 may, for example, be performed by, with the assistance of, and/or under the control of the circuitry of the multi-microphone system 100 embodying at least the plurality of microphone units 102 and the controller 114. The flowchart 700 of FIG. 7 is described in conjunction with the flowcharts 400 and 600 of FIGS. 4 and 6, respectively. Specifically, operation 702 of the flowchart 700 may be initiated after operation 414 of the flowchart 400 or operation 610 of the flowchart 600.

Turning to operation 702, the multi-microphone system 100 includes means, such as the controller 114 in the multi-microphone system 100, for indicating gain level of selected microphone unit on interface of multi-microphone system 100. In an exemplary embodiment, with regards to operation 414 of the flowchart 400, initially the controller 114 may be configured to indicate gain level of the selected microphone unit, i.e. the first microphone unit 102A, on the display interface 116 of the multi-microphone system 100. In additional exemplary embodiment, with regards to operation 610 of the flowchart 600, the controller 114, upon, may be configured to indicate gain level of the selected microphone unit, i.e. the second microphone unit 102B, which is the active microphone unit once the first microphone unit 102A is determined to be overdriven, on the display interface 116 of the multi-microphone system 100.

Turning to operation 704, the multi-microphone system 100 includes means, such as the controller 114 in the multi-microphone system 100, for indicating sensitivity range of selected microphone unit on interface of multi-microphone system 100. In an exemplary embodiment, with regards to operation 414 of the flowchart 400, initially the controller 114 may be configured to indicate a sensitivity range of the selected microphone unit, i.e. the first microphone unit 102A, on the display interface 116 of the multi-microphone system 100. In additional exemplary embodiment, with regards to operation 610 of the flowchart 600, the controller 114 may be configured to indicate a sensitivity range of the selected microphone unit, i.e. the second microphone unit 102B, which becomes the active microphone unit once the first microphone unit 102A is determined to be overdriven, on the display interface 116 of the multi-microphone system 100. Control turns to end operation 708.

In some example embodiments, certain ones of the operations herein may be modified or further amplified as described below. Moreover, in an embodiment additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, such as, a combination of a DSP and a microprocessor, a plurality of microprocessors, one or more microprocessors in conjunction with a DSP core, or any other such configuration. Alternatively, some steps or methods may be performed by circuitry that is specific to a given function.

Embodiments of the present disclosure have been described above with reference to block diagrams and flowchart illustrations of methods, apparatuses, systems and computer program goods. It will be understood that each block of the circuit diagrams and process flowcharts, and combinations of blocks in the circuit diagrams and process flowcharts, respectively, may be implemented by various means including computer program instructions. These computer program instructions may be loaded onto a general purpose computer, special purpose computer, or other programmable data processing apparatus, such as the controller 114, discussed above with reference to FIG. 1, to produce a machine, such that the computer program product includes the instructions which execute on the computer or other programmable data processing apparatus create a means for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the circuit diagrams and process flowcharts, and combinations of blocks in the circuit diagrams and process flowcharts, may be implemented by special purpose hardware-based computer systems that perform the specified functions or steps, or combinations of special purpose hardware and computer instructions.

In one or more aspects, the functions described may be implemented in hardware, software, firmware, or any combination thereof. If implemented in software, the functions may be stored as one or more instructions or code on a non-transitory computer-readable medium or non-transitory processor-readable medium. The steps of a method or algorithm disclosed herein may be embodied in a processor-executable software module (or processor-executable instructions) which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable medium and/or computer-readable medium, which may be incorporated into a computer program product.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present disclosure(s). Furthermore, any advantages and features described above may relate to specific embodiments, but shall not limit the application of such issued claims to processes and structures accomplishing any or all of the above advantages or having any or all of the above features.

In addition, the section headings used herein are provided for consistency with the suggestions under 37 C.F.R. 1.77 or to otherwise provide organizational cues. These headings shall not limit or characterize the disclosure(s) set out in any claims that may issue from this disclosure. For instance, a description of a technology in the "Background" is not to be construed as an admission that certain technology is prior art to any disclosure(s) in this disclosure. Neither is the "Summary" to be considered as a limiting characterization of the disclosure(s) set forth in issued claims. Furthermore, any reference in this disclosure to "disclosure" in the singular should not be used to argue that there is only a single point of novelty in this disclosure. Multiple disclosures may be set forth according to the limitations of the multiple claims issuing from this disclosure, and such claims accordingly define the disclosure(s), and their equivalents, that are protected thereby. In all instances, the scope of the claims shall be considered on their own merits in light of this disclosure, but should not be constrained by the headings set forth herein.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Many modifications and other embodiments of the disclosures set forth herein will come to mind to one skilled in the art to which these disclosures pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the disclosures are not to be limited to the specific embodiments disclosed and that modifications and other embodiments are intended to be included within the scope of the appended claims. For example, the various elements or components may be combined or integrated in another system or certain features may be omitted or not implemented. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

What is claimed is:

1. A multi-microphone system comprising:

a plurality of transducers, wherein each transducer of the plurality of transducers is operable within a sensitivity range such that each transducer has a different sensitivity range than other transducers of the plurality of transducers;

a plurality of microphone units, wherein each microphone unit comprises at least one transducer of the plurality of transducers, and wherein each microphone unit is configured to generate a sound signal output; and a controller communicatively coupled with each microphone unit, wherein the controller is configured to:

receive a sound signal output from a first microphone unit amongst the plurality of microphone units, wherein the first microphone unit corresponds to a microphone unit comprising a transducer with the highest sensitivity of the plurality of transducers;

analyze the received sound signal output of the first microphone unit to identify a first parameter of the received sound signal output;

determine if the first parameter satisfies one or more pre-defined criteria;

in an instance in which the first parameter satisfies the one or more pre-defined criteria:

select the first microphone unit from amongst the plurality of microphone units, and output the sound signal output of the selected first microphone unit as the output of the multi-microphone system; and in an instance in which the first parameter fails to satisfy the one or more pre-defined criteria, receive a sound signal output from a second microphone unit, wherein the second microphone unit corresponds to a microphone unit comprising a corresponding transducer with a sensitivity less than the first microphone unit but greater than any remaining transducer of the plurality of transducers.

2. The multi-microphone system of claim 1, wherein the first parameter corresponds to at least one of a signal clipping parameter of the first microphone unit, a difference between a signal amplitude received by a transducer of the first microphone unit and a midpoint of the sensitivity range of the transducer of the first microphone unit, or a decibels full scale (dBFS) level of the sound signal output of the first microphone unit.

3. The multi-microphone system of claim 2, wherein the signal clipping parameter of the first microphone unit indicates a distortion level of the sound signal output such that a zero value of the signal clipping parameter of the first microphone unit corresponds to an instance in which the sound signal output of the first microphone unit is not clipped.

4. The multi-microphone system of claim 1, wherein the first parameter satisfies the one or more pre-defined criteria in an instance in which the sound signal output of the first microphone unit is not clipped, or in an instance in which the sound signal output is outside of sensitivity ranges of transducers of remaining microphone units of the plurality of microphone units.

5. The multi-microphone system of claim 1, wherein the controller, in an instance in which the first parameter fails to satisfy the one or more pre-defined criteria, is further configured to:

analyze the received sound signal output of the second microphone unit to identify a second parameter of the received sound signal output;

determine if the second parameter satisfies the one or more pre-defined criteria;

in an instance in which the second parameter satisfies the one or more pre-defined criteria, select the second microphone unit from amongst the plurality of microphone units and output the sound signal output of the selected second microphone unit as the output of the multi-microphone system; and in an instance in which the second parameter fails to satisfy the one or more pre-defined criteria, iteratively receive sound signal outputs from subsequent microphone units each comprising respective transducers of decreasing sensitivity.

6. The multi-microphone system of claim 5, wherein the controller is further configured to set the selected microphone unit as an active microphone unit of the multi-microphone system.

7. The multi-microphone system of claim 1, wherein the controller is further configured to indicate:

a gain level of the active microphone unit on an interface of the multi-microphone system; and a sensitivity range of the active microphone unit on the interface of the multi-microphone system.

8. The multi-microphone system of claim 1, wherein the controller is further configured to generate a multi-byte representation of sound signal outputs of the plurality of microphone units, and wherein the generated multi-byte representation comprises one or more first sets of bits and one or more second sets of bits.

9. The multi-microphone system of claim 8, wherein the one or more first sets of bits in the multi-byte representation correspond to sound signal outputs of a first set of microphone units with sensitivity ranges equal to or greater than the sensitivity range of the selected first microphone unit.

10. The multi-microphone system of claim 8, wherein the one or more second sets of bits in the multi-byte representation correspond to sound signal outputs of a second set of microphone units with sensitivity ranges less than the sensitivity range of the selected first microphone unit, wherein the one or more second sets of bits in the multi-byte representation are zero.

11. The multi-microphone system of claim 1, wherein a sensitivity range of at least one transducer in one microphone unit overlaps a sensitivity range of a less sensitive transducer in another microphone unit.

12. A method comprising:

generating, by a plurality of microphone units, a plurality of corresponding sound signal outputs, wherein each microphone unit comprises at least one transducer operable within a sensitivity range such that each transducer of the plurality of microphone units has a different sensitivity range than other transducers of a plurality of transducers;

receiving, by a controller, a sound signal output from a first microphone unit amongst the plurality of microphone units, wherein the first microphone unit corresponds to a microphone unit comprising a transducer with the highest sensitivity of the plurality of transducers;

analyzing, by the controller, the received sound signal output of the first microphone unit to identify a first parameter of the received sound signal output;

determining, by the controller, if the first parameter satisfies one or more pre-defined criteria;

in an instance in which the first parameter satisfies the one or more pre-defined criteria:

selecting, by the controller, the first microphone unit from amongst the plurality of microphone units, and outputting, by the controller, the sound signal output of the selected first microphone unit as the output of the multi-microphone system; and in an instance in which the first parameter fails to satisfy the one or more pre-defined criteria, receiving a sound signal output from a second microphone unit, wherein the second microphone unit corresponds to a microphone unit comprising a corresponding transducer with a sensitivity less than the first microphone unit but greater than any remaining transducer of the plurality of transducers.

13. The method of claim 12, wherein the first parameter corresponds to at least one of a signal clipping parameter of the first microphone unit, a difference between a signal amplitude received by a transducer of the first microphone unit and a midpoint of the sensitivity range of the transducer of the first microphone unit, or a decibels full scale (dBFS) level of the sound signal output of the first microphone unit.

14. The method of claim 12, wherein the signal clipping parameter of the first microphone unit indicates a distortion level of the sound signal output such that a zero value of the signal clipping parameter of the first microphone unit corresponds to an instance in which the sound signal output of the first microphone unit is not clipped.

15. The method of claim 12, wherein the first parameter satisfies the one or more pre-defined criteria in an instance in which the sound signal output of the first microphone unit is not clipped, or in an instance in which the sound signal output is outside of sensitivity ranges of transducers of remaining microphone units of the plurality of microphone units.

16. The method of claim 12, further comprising, in an instance in which the first parameter fails to satisfy the one or more pre-defined criteria:

analyzing, by the controller, the received sound signal output of the second microphone unit to identify a second parameter of the received sound signal output;

determining, by the controller, if the second parameter satisfies the one or more pre-defined criteria;

in an instance in which the second parameter satisfies the one or more pre-defined criteria, selecting, by the controller, the second microphone unit from amongst the plurality of microphone units; and in an instance in which the second parameter fails to satisfy the one or more pre-defined criteria, iteratively receiving, by the controller, sound signal outputs from subsequent microphone units each comprising respective transducers of decreasing sensitivity.

17. The method of claim 16, further comprising:

indicating, by the controller, a gain level of the selected first microphone unit or the selected second microphone unit on an interface of the multi-microphone system, and a sensitivity range of the selected first microphone unit or the selected second microphone unit on an interface of the multi-microphone system.

18. The method of claim 12, further comprising generating a multi-byte representation of sound signal outputs of the plurality of microphone units, wherein the generated multi-byte representation comprises one or more first sets of bits and one or more second sets of bits.

19. The method of claim 18, wherein the one or more first sets of bits in the multi-byte representation correspond to sound signal outputs of a first set of microphone units with sensitivity ranges equal to or greater than the sensitivity range of the selected first microphone unit.

20. The method of claim 18, wherein the one or more second sets of bits in the multi-byte representation correspond to sound signal outputs of a second set of microphone units with sensitivity ranges less than the sensitivity range of the selected first microphone unit, wherein the one or more second sets of bits in the multi-byte representation are zero.

* * * * *